US005887642A

United States Patent [19]

Thomas et al.

[11] Patent Number: 5,887,642

[45] Date of Patent: Mar. 30, 1999

[54] PRESSURIZED SQUEEZE CASTING APPARATUS AND METHOD AND LOW PRESSURE FURNACE FOR USE THEREWITH

[76] Inventors: Robert Anthony Thomas, deceased, late of Solon, Ohio; by James B. Thomas, executor, 7945 Country La., Bainbridge, Ohio 44023; Roger Hale, 2335 Brookhaven, Hinckley, Ohio 44233

[21] Appl. No.: 114,762

[22] Filed: Jul. 14, 1998

Related U.S. Application Data

[60] Division of Ser. No. 828,696, Mar. 31, 1997, which is a continuation-in-part of Ser. No. 490,911, Jun. 16, 1995, abandoned.

[51] Int. Cl.[6] ..... B22D 18/02; B22D 27/11

[52] U.S. Cl. ..... 164/319

[58] Field of Search ..... 164/120, 319, 164/113, 136

*Primary Examiner*—Kuang Y. Lin

[57] ABSTRACT

A pressurized squeeze casting apparatus and method for casting articles includes densifying means for mechanically applying force to a die assembly to compress and densify the molten metal material into a solid article having a near net shape. A shutoff member is provided to seal the interior cavity at the juncture of the runner and the cavity after the cavity is filled with molten metallic material and prior to densification. A low pressure furnace provides a supply of molten metallic material. The outlet from the furnace is biased into engagement with the runner by the gas pressure in the low pressure furnace to ensure a fluid tight connection between the furnace and the runner.

3 Claims, 14 Drawing Sheets

PRESSURIZED SQUEEZE CASTING APPARATUS AND METHOD AND LOW PRESSURE FURNACE FOR USE THEREWITH

RELATED APPLICATIONS

This Application is a divisional of co-pending application Ser. No. 08/828,696, filed Mar. 31, 1997, and entitled, "Pressurized Squeeze Casting Apparatus and Method and Low Pressure Furnace For Use Therewith. The benefit of the filing date of the aforemention U.S. patent application Ser. No. 08,828,696 is hereby claimed." The patent application Ser. No. 08/828,696 is a continuation-in-part of application Ser. No. 08/490,911, filed Jun. 16, 1995, entitled "Pressurized Squeeze Casting Apparatus", now abandoned.

DESCRIPTION—TECHNICAL FIELD

The present invention relates to a method and apparatus for casting articles from a molten metal material and densifying the molten metal material to remove porosity and air from the solidified cast article and to form a near net shaped article having superior strength characteristics and which requires minimal or no machining to finish the article. In particular, the disclosed method and apparatus mechanically pressurizes and rotates the mold apparatus or uses a low pressure fill technique to remove air, fill the die with molten metal material, and compress and densify the molten metal material to form a near net shape article.

In addition, one embodiment of the present invention illustrates a simplified squeeze casting machine which places all of the forces on the centerline of the machine through the die assembly and the interior cavities to provide for a linear densification process which prevents one die member from cocking relative to the other die member.

In addition, a low pressure furnace is disclosed to fill the cavities in the squeeze casting machine and provides for an efficient filing process which is extremely cost efficient compared to hand loading of the molten material into the die assembly. The present invention also improves over the prior art by utilizing a shutoff member which seals the interior cavity at the juncture of the runner and the interior cavity and allows any excess molten material in the runner to drain back into the low pressure furnace for reuse thereby increasing the yield of the process.

BACKGROUND OF THE INVENTION

Known casting techniques are degraded due to air entrapment within the molten metal material introduced into a casting mold. The entrapped air forms pores in the molded article which weaken the structure and which degrade the metallurgical integrity of the article. In known casting methods, when a volume of molten metal material within a mold cools, it shrinks as it transforms from a molten state to a solid state. Pores result from air entrapped in the mold and the shrinking of the molten material increases the difficulty of obtaining near net shape castings. Shrinkage changes the size of the article and results in void cavities and pores in the article, thus making it unheatreatable. This results in lower mechanical properties and an inferior product. Near net shape castings are casting which require little or no finishing or machining for the articles to be of a predetermined shape and size.

It is known to use pressure to force air from a mold as well as to minimize the space occupied by the air to thereby decrease the size of the resulting pores in the cast article.

One known die casting method includes a plunger which extends into a central region of the mold cavity to densify the metal proximate to the plunger. The pressure from the plunger compresses the molten metal to densify the material and reduce air spaces or voids within the material. The known die casting devices, such as that which utilize a central plunger, effect greater densification of the metallic material proximate the plunger than material which is spaced apart from the plunger. This results in uneven density in the cast article.

It is desirable to produce near net shape cast metallic articles which have a uniform density and which have desirable metallurgical properties, such as like those found in forgings. It is further desirable to be able to cast near net shaped articles having more complicated geometries than is normally allowed in forging operations wherein the metallurgical properties of the article are desirable and which rival that of a forged part.

The prior art utilizes complicated tooling which provides for relative movement within the die members during the densification process, i.e, the densification member moves relative to one of the die members. This requires replacement of the densification members when the tooling is replaced. One embodiment of the present invention overcomes this disadvantage by moving the platen and die member mounted thereon by the densifying assembly which allows replacement of the tooling without modification of the densifying assembly. This represents a substantial savings over prior art constructions which require modification of the densifying assembly every time a new die member is placed in the squeeze casting apparatus.

SUMMARY OF THE INVENTION

The present invention provides a new and improved pressurized squeeze casting apparatus for compressing and densifying a molten metal material as the molten metal material is solidified into a solid article having a near net shape, including molding means having a mold portion having an interior cavity shaped substantially to form a solid article and including a runner for introducing molten material into the interior cavity with the molding means being rotatable from a first orientation in which molten metal is introduced into the interior cavity to a second orientation in which molten metal is solidified and further including densifying means for mechanically applying force to the mold to compress and densify the molten material to cast a solid article having a predetermined near net shape.

Another provision of the present invention is to provide a new and improved pressurized squeeze casting apparatus as set forth in the preceding paragraph further including a molten material shutoff element movable between a retracted position in which the molten material is adapted to flow between the runner and the interior cavity and a sealing position in which the molten metal material is prevented from flowing from the interior cavity and wherein the shutoff element in part defines the interior cavity and a portion of the article to be cast when it is in its sealing position.

A further provision of the present invention is to provide a pressurized squeeze casting apparatus for compressing and densifying molten metal material to a near net shape article, including a first mold portion and a second mold portion, the first mold portion being movable relative to the second mold portion between an open position and a closed position, the first and second mold portions when in the closed position defining at least a portion of an interior cavity shaped substantially to form the solid article to be cast, densifying means for effecting relative movement of the first mold portion and second mold portion to reduce the volume of the interior cavity after the interior cavity has received the molten metal therein to compress and densify the molten metal in the interior cavity, and flow prevention means for preventing the flow of molten metal material from the interior cavity when the densifying means effects reduction of the volume of the interior cavity.

Another provision of the present invention is to provide a new and improved pressurized squeeze casting apparatus as set forth in the preceding paragraph wherein the flow prevention means includes a shutoff element having a retracted position and a sealing position which seals said interior cavity and wherein the shutoff element, when in the sealing position, defines in part the interior cavity and a portion of the solid article to be cast.

A still further provision of the present invention is to provide a new and improved pressurized squeeze casting apparatus including a first mold portion shaped to define a portion of an article to be cast, a second mold portion shaped to define another portion of the article to be cast, the first and second mold portions being movable between an open position and a closed position, the first and second mold portions shaped to define at least a portion of the interior cavity to form the article to be cast when in the closed position, densifying means for forcibly moving the first mold portion relative to the second mold portion to reduce the volume of the interior cavity after the interior cavity has been filled with molten material to compress the molten material, and wherein the first mold portion and second mold portion, when in their closed position, are movable between a filled position wherein the interior cavity volume is greater than the volume of the solid metallic article to be cast and a densifying position wherein the interior cavity volume is reduced by the densifying means to equal the volume of the solid metallic article.

The present invention provides a new and improved pressurized squeeze casting apparatus for receiving molten metal material and compressing and densifying the molten metal material as the molten metal material solidifies into a solid metallic article having a predetermined near net shape, including a mold means defining an interior cavity shaped substantially to form a solid metal article, the molding means being rotatable from a first orientation to a second orientation, supply means for retaining the molten material to be poured into the interior cavity, the supply means being operatively connected to the molding means at any rotational orientation of the molding means, rotating means for simultaneously rotating the molding means and the supply about a common substantially horizontal axis from the first orientation to the second orientation whereby molten metal material is introduced into the interior cavity, densifying means for applying pressure on the mold portion to reduce the volume of the interior cavity and compress the molten metal material introduced into the interior cavity.

A further provision of the present invention is to provide a method of squeeze casting an article from molten material in a squeeze casting apparatus including first and second platens movable relative to each other and each of which support a die member which cooperate to define an interior cavity, a runner for introducing molten material to the cavity and a shutoff member located at the intersection of the runner and the interior cavity for sealing the interior cavity and which has a surface thereon which in part defines a portion of the interior cavity including the steps of sequentially moving the first and second platens and associated die members relative to each other from an open to a closed position to in part define the interior cavity, flowing molten material through the runner to the interior cavity, filling the entire interior cavity with molten material, moving the shutoff member into its sealing position when the interior cavity is filled to seal the interior cavity at the juncture of the runner and the interior cavity and to position the surface of the shutoff member to define a portion of the interior cavity and densifying the molten material in the cavity by reducing the volume of the interior cavity.

Another provision of the present invention is to provide a new and improved method of squeeze casting an article as set forth in the previous paragraph further including the steps of flowing the molten material at low pressure through the runner to the interior cavity, reducing the pressure on the molten material after the step of moving the shutoff member to seal the interior cavity is completed and flowing from the runner under the influence of gravity, the molten material remaining in the runner after the step of moving the shutoff element to seal the interior cavity is completed.

Still another provision of the present invention is to provide a new and improved method of casting an article in a die assembly having a verticle parting line which includes first and second die members which define at least a single interior cavity shaped to form an article to be cast, a runner for introducing molten material to the interior cavity and for receiving a supply of molten material from a low pressure furnace including a stocktube having an outlet connected to a manifold assembly having an outlet which is adapted to be placed in fluid communication with the runner including the steps of locating the furnace with the manifold assembly in a position to communicate with the inlet to the runner, moving the first and second die members from an open position to a closed position in which the runner is positioned in fluid communication with the manifold assembly, pressurizing the furnace with a supply of low pressure gas with a sufficient pressure to flow molten material through the stocktube to the manifold assembly and from the manifold assembly to the runner to fill the interior cavity with molten material and biasing the outlet of the manifold assembly into sealing fluid tight engagement with the inlet to the runner with the pressure from the low pressure gas in the furnace.

Another provision of the present invention is to provide a new and improved method of casting an article from molten material in a die assembly having first and second relatively movable die members each having a bottom surface and each of which defines a portion of an interior cavity, a runner for introducing molten material to the interior cavity from a low pressure furnace having a manifold assembly which is located below the die assembly and which is adapted to be moved into fluid communication with the runner including the steps of locating and maintaining the low pressure furnace with the manifold assembly below the die assembly and in engagement with the bottom surface of the first die member, moving the second die member from an open position to a closed position in which the second die member engages the manifold assembly and the outlet to the manifold assembly is in fluid communication with the runner, biasing the manifold assembly in an upwardly direction into sealing engagement with the runner, pressurizing the furnace with a supply of low pressure gas to flow molten material from the furnace, to the manifold assembly to the runner to fill the interior cavity, solidifying the molten material in the interior cavity, moving the second die member from its closed position to its open position and ejecting a cast article from one of the die members.

Still another provision of the present invention is to provide a squeeze casting apparatus from squeeze casting an article for molten material including a first platen, a first male die member supported for movement with the first platen, a second platen, a female die member supported for movement with the second platen, an ejector mechanism including at least a single ejector pin carried by the second platen for ejecting a cast article from the female die member, the second platen being movable from an open position to a closed position to in part define an interior cavity for receiving molten material, the first platen and male die member being movable toward the second platen and female die member when the first and second platens are in their closed position to reduce the volume of the interior cavity and squeeze cast an article therein and densifying means for moving the first platen toward the second platen to densify the molten metallic material in the interior cavity.

A further provision of the present invention is to provide a low pressure furnace for providing a supply of molten metallic material at low pressure to a die assembly which includes at least a single interior cavity, and a runner, the furnace including a chamber having a supply of molten metallic material therein, a stocktube extending into the chamber and a low pressure gas supply communicating with the chamber to establish a sufficient pressure on the molten metallic material to flow the molten metallic material through the stocktube. The manifold assembly is in fluid communication with the inlet to the runner of the die assembly and with the outlet to the stocktube and is movable in a vertical direction from a retracted position to an extended position in which the manifold assembly is engaged with the lower portion of the die assembly and the manifold assembly is in fluid communication with the runner. A flexible conduit means is disposed between the manifold assembly and the chamber for providing a flexible fluid tight connection between the chamber and the manifold assembly which enables the manifold assembly to move relative to the chamber without leakage of low pressure gas from the furnace and biasing means is provided for biasing the manifold and the flexible conduit means into engagement with the lower portion of the die assembly to provide a sealed connection between the outlet of the manifold assembly and the runner to provide a fluid path for the molten metallic material from the stocktube through the manifold assembly to the runner.

Still another provision of the present invention is to provide a low pressure furnace as set forth in the preceding paragraph wherein the biasing means includes the low pressure gas supply which exerts a biasing pressure on the manifold assembly to bias the manifold assembly in an upwardly direction into engagement with the lower portion of the die assembly.

A further provision of the present invention is to provide a new and improved low pressure furnace for providing a supply of molten metallic material at low pressure to a die assembly which includes at least a single interior cavity shaped to define an article to be cast and a runner having a substantially verticle orientation and an inlet on the lower portion of the die assembly, the furnace including a chamber having a supply of molten metallic material therein, an opening located in the top of the chamber, a stocktube extending through the opening, a low pressure gas supply communicating with the chamber for establishing a sufficient pressure to flow molten metallic material through the stocktube to fill the interior cavity, a manifold assembly adapted to be placed in fluid communication with the runner on the die assembly and in fluid communication with the stocktube, the stocktube being connected to the manifold assembly and being movable with the manifold assembly in a verticle direction relative to the opening in the top of the chamber from a retracted position to an extended position which the manifold assembly is engaged with the lower portion of the die assembly and the manifold assembly is in fluid communication with the runner. Flexible conduit means is disposed between the manifold assembly and the chamber to provide a flexible fluid tight connection for preventing low pressure gas in the chamber from escaping, and biasing means are provided for biasing the manifold assembly, stocktube and flexible conduit means in an upwardly direction into engagement with the lower portion of the die assembly to provide a sealed connection between the manifold assembly and the runner and provide a fluid path for the molten metallic material to pass from the stocktube, through the manifold assembly to the runner to fill the interior cavity in the die assembly.

Another provision of the present invention is to provide a low pressure furnace as set forth in the preceding paragraph, wherein the biasing means includes the low pressure gas which exerts a biasing pressure on the manifold assembly to bias the manifold assembly and the flexible conduit means in an upwardly direction into engagement with the lower portion of the die assembly when the pressurized gas establishes sufficient pressure on the molten metallic material to flow the molten metallic material from the chamber to the interior cavity.

DESCRIPTION OF THE PREFERRED EMBODIMENT

Figure 1:
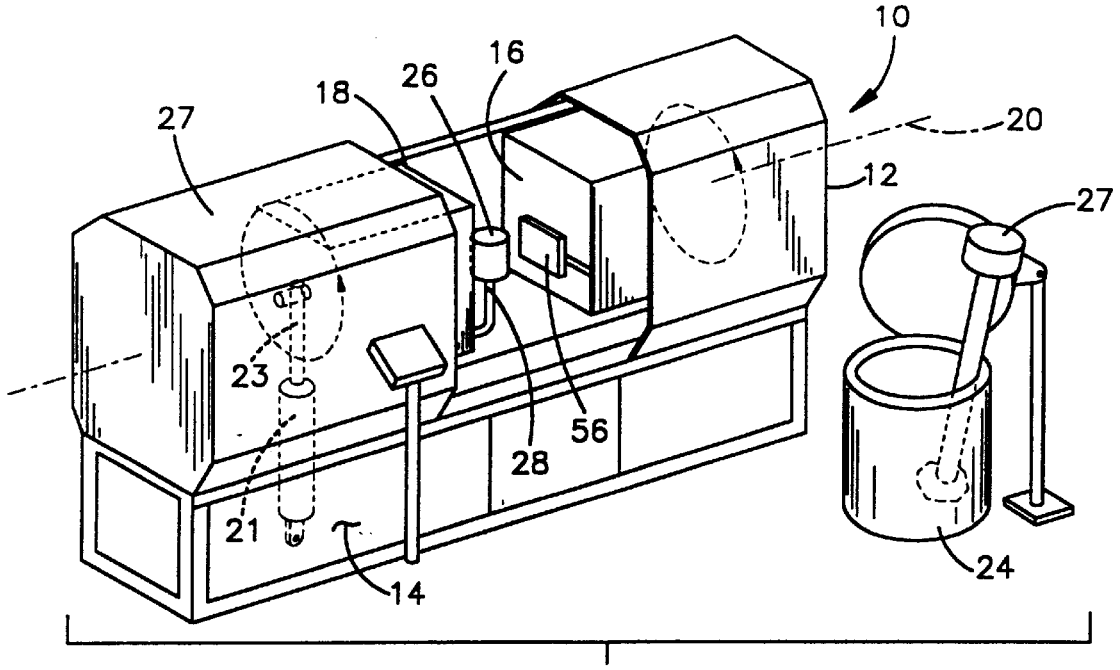
FIG. 1 is a front perspective view of the pressurized squeeze casting apparatus of the present invention illustrating the die and mold members in an open position.

Referring to the Figures, and more particularly to FIG. 1, a perspective view of the pressurized squeeze casting apparatus 10 of the present invention is generally illustrated. The squeeze casting apparatus 10 includes a housing 12 and a base 14. A pair of dies 16, 18 are supported on the base 14 for both horizontal movement and rotation about a horizontal axis 20 as will be more fully described hereinbelow. The dies 16, 18 are movable from an open position, illustrated in FIGS. 1 and 5, to a closed position, as is illustrated in FIG. 2.

A crucible-type furnace 24 having a mixer 27 may be provided for heating and mixing the molten metal material to be introduced into the squeeze casting apparatus 10. A pour cup 26 is connected to the die member 18 and is movable with die member 18. Molten metal material can be transferred from the crucible furnace 24 to the pour cup 26 in a well-known manner, to supply the molten metal material which is to be cast into a solid article via the squeeze casting apparatus 10. While a separate furnace 24 has been illustrated for filling pour cup 26, a continuous source of low pressure molten metal material could be provided for the squeeze casting apparatus 10 either to fill pour cup 26 or to supply molten metal material directly to the dies. If a low pressure fill system is utilized, the molten metal material is introduced into the bottom of the cavity defining the article to be cast, as is well known in low pressure fill systems. Rotating the mold is not required when utilizing a low pressure continuous fill system, but is desired when the pour cap 26 is used.

Figure 2:
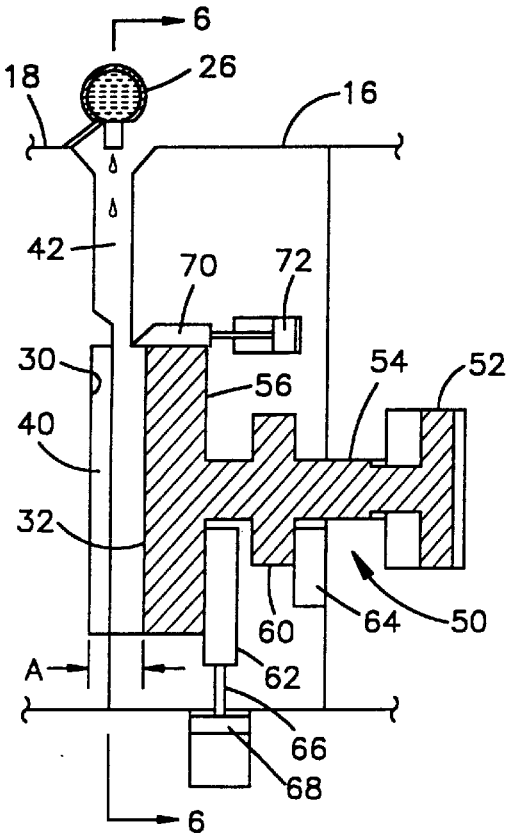
FIG. 2 is a cross-sectional view of the pressurized squeeze casting apparatus in a fill position in which molten metal material is about to be introduced into the mold.
Figure 3:
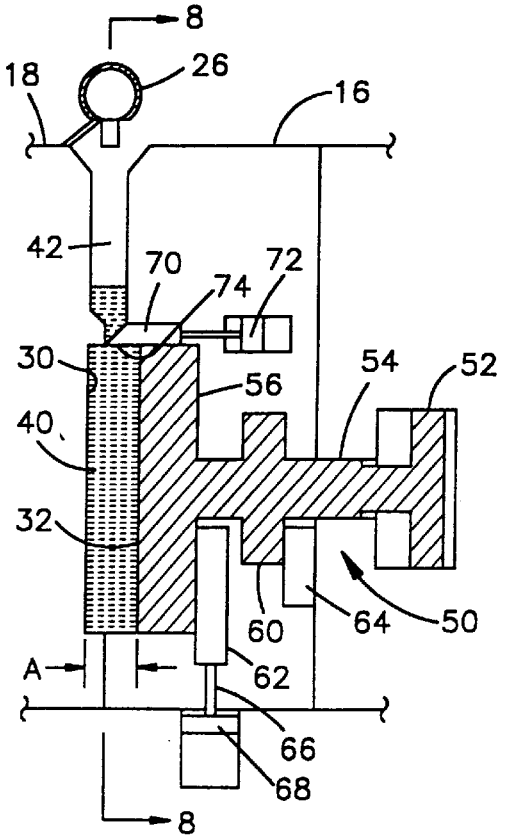
FIG. 3 is a cross-sectional view of the pressurized squeeze casting apparatus as illustrated in FIG. 2 showing the mold filled with molten metal material and illustrating the molten material shutoff element in a position in which it prevents flow between the runner and the interior cavity.
Figure 4:
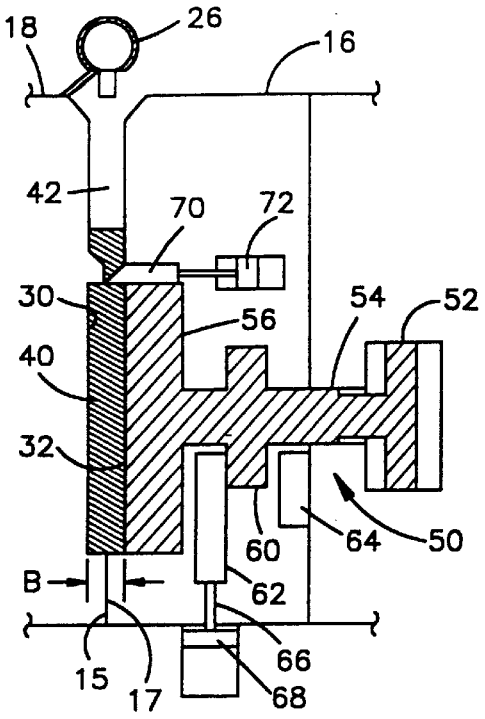
FIG. 4 is a cross-sectional view of the pressurized squeeze casting apparatus of the present invention similar to FIG. 3 showing the densifying means in a position in which it has reduced the volume of the interior cavity and densified and compressed the molten metal material to its desired near net shape.
Figure 5:
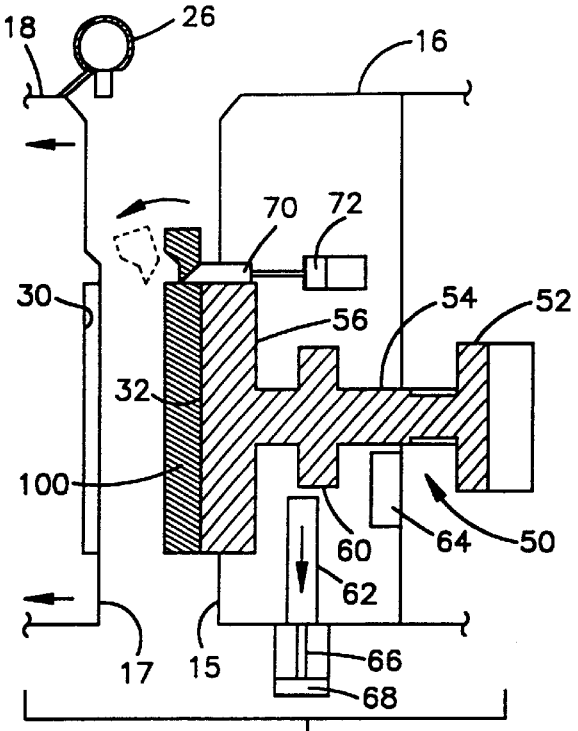
FIG. 5 is a cross-sectional view of the pressurized squeeze casting apparatus similar to that set forth in FIG. 2 wherein the dies and mold members are in an open position and the solid metallic article is in the process of being ejected from the mold by the densifying means.

Referring to FIGS. 2–5, the die sections 16, 18 are more fully illustrated. The die sections 16, 18 can be spaced apart or open, as is illustrated in FIG. 1 and FIG. 5, or can be moved relative to each other to a closed position as illustrated in FIGS. 2–4. In the preferred embodiment, the die section 16 is horizontally stationary within housing 12 and die section 18 is movable in a substantially horizontal direction from its position illustrated in FIGS. 1 and 5 in which the die section 18 is spaced apart from the die section 16 to its position shown in FIG. 2 in which the die section 18 engages with the die section 16 when the dies are in their closed position. Hydraulic cylinders, not illustrated, can be provided to effect reciprocation of the die portion 18 in a horizontal direction to effect relative movement of die sections 16, 18 between their open and closed position.

Die sections 16, 18, when in their closed position, are rotatable about the horizontal axis 20 by energizing a hydraulic cylinder 21 which includes a piston 23 connected to the die section 18 to rotate the die section in a suitable rotating means or mechanism shown schematically in FIG. 1 at 27. The mechanical assembly 27 which supports the die sections 16 and 18 for rotation about the horizontal axis 20 can be programmed to vary the rate of rotation of the dies 16, 18. The rate of rotation can be controlled according to the magnitude and/or uniformity of the angular velocities of rotation as well as the angle through which the dies 16, 18 rotate, which affects the rate of fill. The rate and angle are controlled for the configuration of the article being cast to minimize air entrapment during fill and porosity in the finished metallic article.

The pour cup 26, which is adapted to receive molten metal material therein for casting the metallic article is attached to the die section 18 for movement therewith in a horizontal direction and is adaptable to rotate with the die section 18 about the horizontal axis 20. The pour cup 26 is maintained at an elevated temperature by a burner assembly 28 which is provided with a supply of combustible gas which heats the pour cup 26 to prevent molten metal material which is introduced in the pour cup 26 from solidifying. In addition, the burner assembly 28 can be utilized to keep the molten metal material which is introduced into the pour cup 26 at a predetermined, elevated temperature which facilitates the flow of molten metal material from the pour cup 26 into the die sections 16, 18, as will be more fully described hereinbelow.

Each of the die sections 16, 18 include a mold portion therein which define, at least in part, the article to be molded. The die section 16 includes the mold portion 32 and the die section 18 includes the mold portion 30. When the dies 16, 18 are in their closed position, the mold portions 30, 32 define an interior cavity 40 which is adapted to receive the molten metal material to define the article to be cast.

The interior cavity 40 is located on the engaging surfaces 15, 17 of dies 16 and 18 which also define a runner 42 for directing molten metal material into the interior cavity 40 defined by mold members 30, 32. The runner 42 is aligned with the pour cup 26 so that when the die sections rotate, molten metal material flows from the pour cup 26 directly into the runner 42. Suitable protuberances 13 can be provided on the meeting surfaces 15, 17 of die sections 16, 18 to register and align the die sections when they are in their closed position, as is well known in the art. Air vents 44 are formed as shallow channels, approximately 0.003" to 0.005" deep in the surfaces 15, 17 of die sections to allow for an escape path for air forced from the mold. Molten metal within the mold is prevented from escaping through the air vents 44 by the "chill" in the vent which causes immediate solidification of any molten metal if the molten metal attempts to escape through the vent 44.

In the preferred embodiment of the invention, the mold sections 30, 32 are designed to cast a bar shaped object 100 with flanged ends (see FIG. 6), however, it should be appreciated that other articles of various shapes and configurations could be cast using a method and apparatus of the present invention. Mold portion 32 is slidably received in die section 16 and, as is schematically illustrated, is located on the distal, planar end of a densifying assembly 50 supported in die section 16, more fully described hereinbelow, and mold portion 32 forms the entire side contour of the article being cast. Mold member 30 is formed as a portion of die section 18. While the mold members 30, 32 have been disclosed as being a portion of the die section 18 and a portion of the densifying assembly supported by die section 16, separate mold inserts (not illustrated) to the die section could be utilized to define the interior cavity 40. The use of mold inserts in die section 16, 18 allows the configuration of the article to be cast to be readily changed by replacement of the mold inserts.

The densifying assembly 50, which is supported for horizontal and rotational movement with die section 16, includes a hydraulic piston 52, a piston shaft 54, and an outer distal planar plate 54 which includes the mold portion 32 disposed at the flat distal end thereof. The hydraulic piston 52 is operable to be moved in a horizontal direction, as illustrated in FIGS. 2–5 to vary the volume of the interior cavity 40. A stop abutment 60 may be located on the piston shaft 54 as a means of positively controlling the position of hydraulic position and plate 54 and the volume of the interior cavity 40 during various steps of the squeeze casting process. The stop abutment 60 cooperates with a pair of stop members 62 and 64 which positively engage with the densifying assembly 50 to predetermine and control the volume of the interior cavity 40 during different steps of the squeeze casting process. The stop member 62 is connected via a piston rod 66 to a piston member 68 to effect movement of the stop member 62 in a vertical direction from its extended position illustrated in FIGS. 2–4 in which the stop member 62 is adapted to engage with stop abutment 60 to its retracted position as is illustrated in FIG. 5 and in which the stop member 62 cannot engage with stop abutment 60. The stop member 64 is secured to die section 16 proximate to stop abutment 60 on piston shaft 54.

A molten metal shutoff element 70 is connected to the hydraulic piston 72 to seal runner 42 and shutoff communication between the runner 42 and the interior cavity 40 to prevent the flow of molten metal material between the runner and the interior cavity 40. The shutoff element or member 70 includes a surface 74 which is contoured to cooperate with the mold members 30, 32 to define the interior cavity 40 and a portion of the article to be cast. When the shutoff member 70 is extended to its sealing position, illustrated in FIG. 3, shutoff member 70 prevents communication between the runner 42 and the interior cavity 40. While a molten metal shutoff element 70 has been illustrated to prevent flow between the interior cavity 40 and the runner 42, the element 70 could be replaced by a chill pin which cools the molten metal to effect instant solidification of the metal by cooling to seal runner 42 and prevent flow between interior cavity 40 and the runner 42.

When it is desired to cast an article, the die sections 16, 18 are closed and the densifying assembly 50 is retracted, as is illustrated in FIG. 2, until the stop abutment 60 on piston shaft 54 engages with the stop member 64. Retraction of the densifying assembly 50 to the position in which stop member 64 engages stop abutment 60 presets the volume of the interior cavity 40 so that the interior cavity 40 can receive an accurately controlled predetermined amount of molten metal material. The dimension A in FIG. 3 represents the distance between the mold members 30, 32 when the densifying assembly 50 is in its fully retracted position and stop abutment 60 engages stop member 64, which determines the volume of the interior cavity 40 and the volume of the molten metal material to be received therein to cast the article. While the stop member 64 and stop shoulder 60 are disclosed as cooperating to determine the distance A and the volume of the recess 40, other means such as a LVDT or other means could be utilized to positively position the densifying assembly 50 to positively predetermine the volume of the interior cavity 40. For example, the use of a separate stop member 64 could be eliminated if suitable stop surfaces were disposed on die section 16 to engage with stop abutment 60 when the densifying assembly 50 was fully retracted.

As is illustrated in FIG. 2, the densifying assembly 50 is retracted to preset the dimension A and predetermine the volume of interior cavity 40. Molten metal material is then introduced into the runner 42 from the pour cup 26 and cavity 40 and runner 42 are filled with the molten metal material to be cast, as is illustrated in FIG. 3. When the cavity 40 is filled with the molten metal material, the shutoff pin 70 is actuated by movement of the hydraulic piston 72 to its sealing position illustrated in FIG. 3 in which the shutoff pin 70 extends into and seals the runner 42 to prevent flow of the molten metal material between the runner 42 and the cavity 40. The cavity 40 at this time is filled with a predetermined amount of molten metal material which is determined by the dimension A and the placement of stop abutment 60 and stop member 64.

After the interior cavity 40 is filled with molten metallic material and the shutoff pin 70 is moved to its extended or sealing position, the densifying assembly 50 will move under the force of hydraulic piston 52 from its position illustrated in FIG. 3 to its position illustrated in FIG. 4 wherein the mold member 32 is moved toward the left to reduce the volume of interior cavity 40 to compress and densify the molten metal material which is in the interior cavity 40. It should be realized that the entire mold member 32 is moved to densify the molten material. This effects a uniform densifying pressure on substantially the entire face of the article to be cast in contrast to prior art devices which pressurize the molten material at a localized location. Applying densifying pressure to substantially the entire face of the article to be cast provides superior metallurgical properties than if local densification pressure is utilized. The densifying assembly 50 continues to compress the molten metal material in cavity 40 until the stop abutment 60 engages with the stop member 62. Engagement of stop abutment 60 with stop member 62 positively sets dimension B which is the desired dimension of the interior cavity 40 after actuation of the densifying assembly 50. The dimension B represents the thickness of the molten metallic material as it is compressed and as it shrinks during its solidification into the solid cast article. Movement of the densifying assembly 50 to its position in FIG. 4 compresses the molten metallic material in the cavity 40 to reduce porosity and entrapped air in the molten metal material, provide a more accurately controllable and repeatable casting process, and provide an article having metallurgical characteristics which approach that of a forged part. Strong, low weight metal alloy components having dimensional consistency can be produced using the present apparatus.

After the densifying assembly 50 is moved to its position illustrated in FIG. 4, the molten metal material in the mold is allowed to solidify under pressure and the die section 18 is then moved away from the die section 16 to provide for removal of the article from the mold members 30, 32. As the die member 18 moves away from the die member 16, stop member 62 can be retracted to allow the densifying assembly 50 to be further moved toward the left, as is illustrated in FIG. 5 to positively eject the solidified article from the mold members.

When it is desired to cast an article, molten metal material is prepared for introduction into the pouring cup 26. The molten metal material is prepared in the crucible 24 and a commercial ladling system as is known in the art can be employed to transfer a portion of the molten metal material to the pour cup 26. Initially the die sections 16, 18 are in their open positions and are spaced apart and aligned in a first rotational orientation such as disclosed in FIGS. 2 and 6 wherein the pour cup 26 is disposed in a substantially horizontal position for receiving the molten metal material therein. The die sections 16, 18 are then moved to their closed position and a predetermined quantity of molten metal material is introduced into the pour cup 26. The molten metal material is retained at a high temperature in the pour cup 26 by the burner 28. The amount of molten metal material introduced into the pour cup 26 need not be precisely measured but merely needs to be enough to fill the interior cavity 40 up to the shutoff element 70 when the cavity is in its position shown in FIG. 3 and FIG. 8. When the molten metal is introduced into the pour cup 26, the shutoff pin 70 is retracted and the densifying assembly 50 is in its retracted state which then defines the volume of interior cavity 40 wherein the distance A is predetermined when the densifying assembly 50 is in its fully retracted state. The volume of the interior cavity 40 is greater than the volume of the finished cast article when the densifying assembly 50 is in its fully retracted position.

Figure 6:
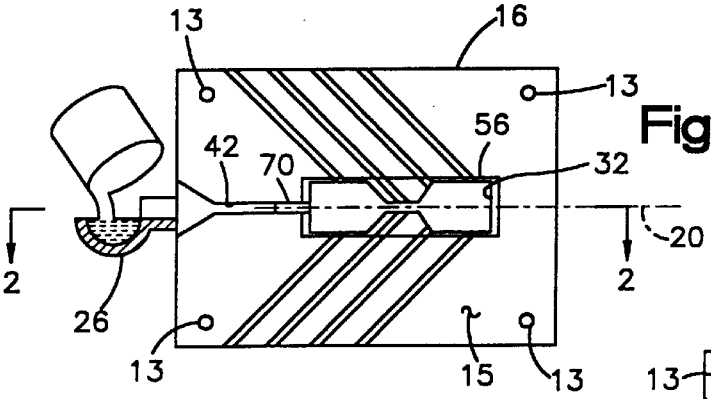
FIG. 6 is a cross-sectional view taken approximately along the lines 6—6 of FIG. 2 illustrating the mold and die member in a position in which it is adapted to receive molten metal material.
Figure 7:
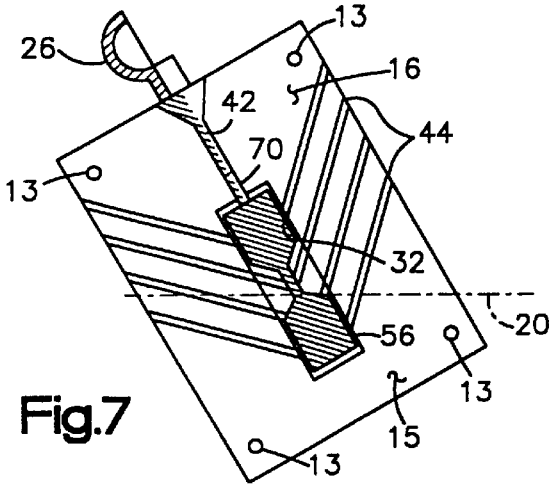
FIG. 7 is a cross-sectional view similar to FIG. 6 illustrating the die and mold as it rotates from its first orientation illustrated in FIG. 6 to its second orientation illustrated in FIG. 8.

After the molten metal material is introduced into the pour cup 26, the mechanical rotating assembly initiates rotation of die sections 16, 18 from their position located in FIG. 6 to their position located in FIG. 7. During the initial stage of rotation, the mechanical rotating assembly rotates the die sections 16, 18 at a generally uniform rate of about 45 degrees per second. This rate has been found effective to minimize the entrapment of gases within the interior cavity 40. Different rates may be utilized depending upon the construction of the articles to be cast and the complexities of the mold portions 30, 32 which define the interior cavity 40. The rotation minimizes the entrapment of gases within the interior cavity 40 and within the molten metal material to provide a casting product of reduced porosity using a non-turbulent, rotational or low-pressure fill.

The pour cup 26 is attached to the die section 18 such that when the die sections 16, 18 rotate, the contents of the pour cup begins to pour into the runner 42 and then into the interior cavity 40, all under the force of gravity for a rotational fill. For a low pressure fill, the die sections 16, 18 can be stationary or rotate, depending upon the part configuration and number of cavities in each die section. As the molten metal is introduced into the cavity 40, any air or gas in cavity 40 gradually displaces therefrom and moves upwardly and outwardly through the runner 42. As the rotation continues, the cavity is completely filled and the molding components are as substantially illustrated in FIGS. 3 and 8.

The shutoff element 70 is actuated to move into sealing engagement with the runner 42 as the die sections 16 and 18 rotate from about 75° to 80° with respect to the horizontal 20. The shutoff element 70 seals the runner 42 and prevents the flow of molten metal material between the runner 42 and the interior cavity 40. Any molten metal material which has been introduced into runner 42 which is in excess of that required to form the article to be cast is sealed on the outside of the interior cavity 40 in the runner 42 by the shutoff element 70.

Figure 8:
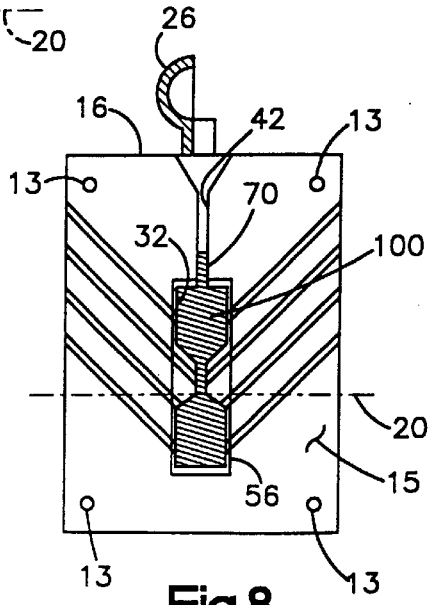
FIG. 8 is a cross-sectional view taken approximately along lines 8—8 of FIG. 3 illustrating the mold and die rotated to their second orientation to effect flow of the molten metal material into the interior cavity of the mold.

When the die sections 16, 18 reach the position shown in FIGS. 4 and 8, the densifying assembly 50 is actuated to begin to compress the molten metal material within the interior cavity 40. The hydraulic piston 52 forcibly mechanically moves the plate portion 56 of the densifying assembly 50 toward the die section 18 to move mold portion 32 toward mold portion 30. As the volume of the interior cavity 40 is decreased, excess air within the mold cavity is forcibly expelled through the vents 44. The pressure of the molten metal material within the interior cavity 40 increases to compress and densify the material and reduce any porosity therein. Shutoff pin 70 seals the runner 42 to prevent the pressurized molten metal material from escaping from the interior cavity 40.

Densification continues until the mold portion 32 reaches a final position, as shown in FIG. 4, wherein the stop abutment 60 engages the extended stop member 62 to positively position mold member 32 relative to mold member 30. At this position, the material within the mold has been fully densified and will experience little or no shrinkage as the material cools and solidifies. Thus, the cavity will accurately define the dimensions and contour of the finished article. The differences between distance A and distance B corresponds to the additional volume of molten metal material required in the interior of the cavity 40 to account for variable material shrinkage plus an amount of densification and compaction of the molten metal material to compact the grain structure and form a near net shape cast article having metallurgical properties similar to that of a forged part. The amount of compression and the difference between distance A and distance B depends upon the particular article to be cast, the alloy of the particular molten metal material being cast, the solidification shrinkage of the particular alloy to be poured, and the waste allowance.

During densification, molten metal material within the interior cavity 40 is cooled by the lower temperature of the dies 16, 18 and solidifies from a liquid state to a solid state. In some instances, it may be desirable to provide cooling to the die members 16, 18, as is well known in the art. The cooling of die members 16, 18 would accelerate the cooling and solidification of the article to be cast. During the final stages of densification, or preferably immediately thereafter, the mechanical rotating assembly rotates the dies 16, 18 to their initial orientation illustrated in FIG. 6 and FIG. 5, wherein the pour cup 34 is disposed in a substantially horizontal position. In the case of a low pressure, non-rotational fill, the dies remain in their initial orientation. The die section 18 is then retracted away from the die section 16, the stop member 62 is retracted and piston 52 is further energized to eject the article 100 from the mold 32. Although it is contemplated that the die sections 16, 18 rotate to their initial orientation, as is illustrated in FIG. 6, the dies could be separated in any other rotational orientation and the article 100 ejected. As the article 100 is ejected, any excess metal in the runner 42 is also ejected. In some embodiments, the shutoff element may be further extended to positively eject any excess molten material in the runner 42.

Figure 9:
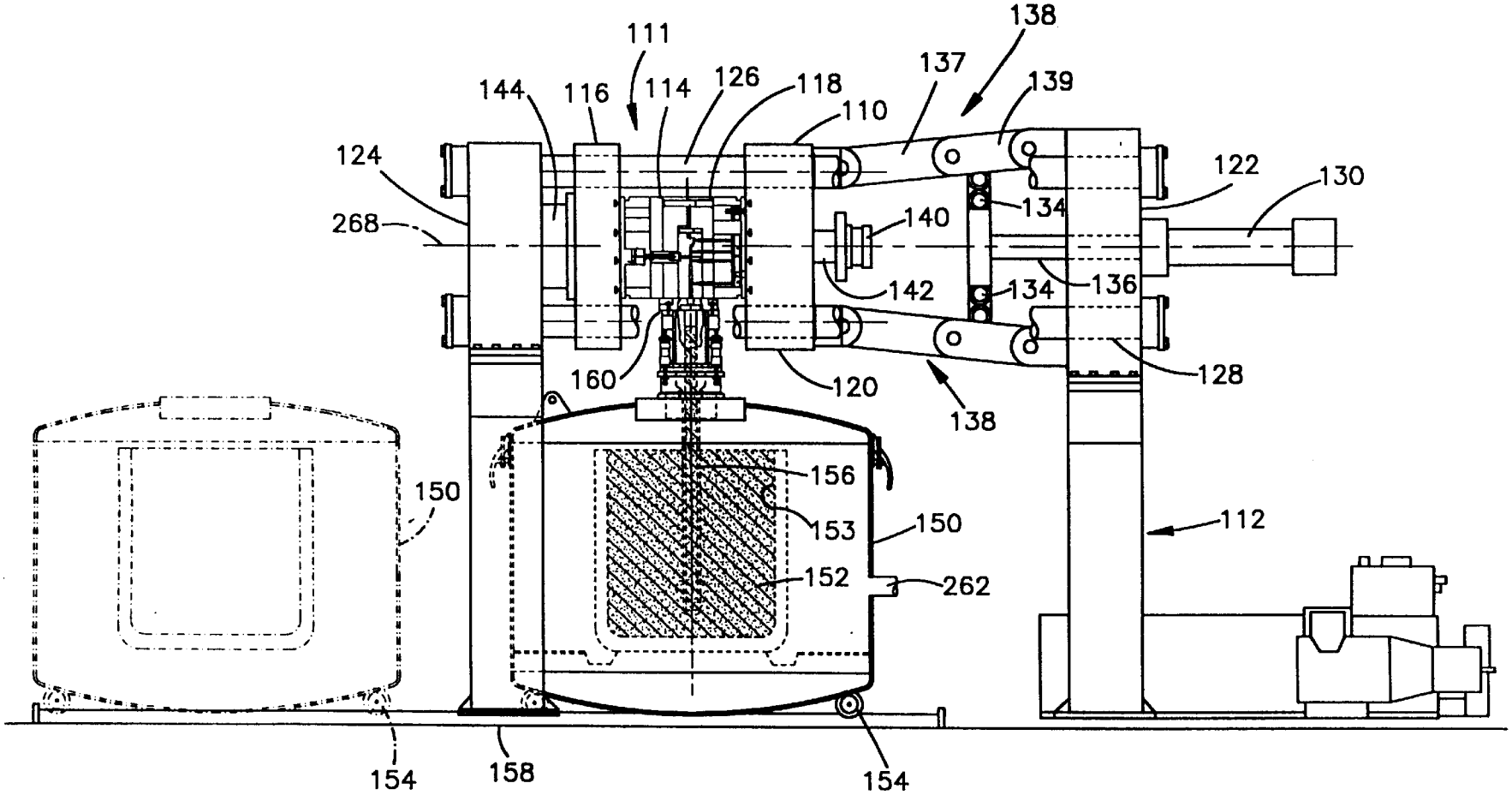
FIG. 9 illustrates a side view of a further embodiment of the squeeze casting apparatus of present invention illustrating the die assembly in its closed position and illustrating the furnace and in full lines in position to fill the interior cavity of the die assembly and in phantom lines illustrating the furnace removed from the die casting apparatus.
Figure 10:
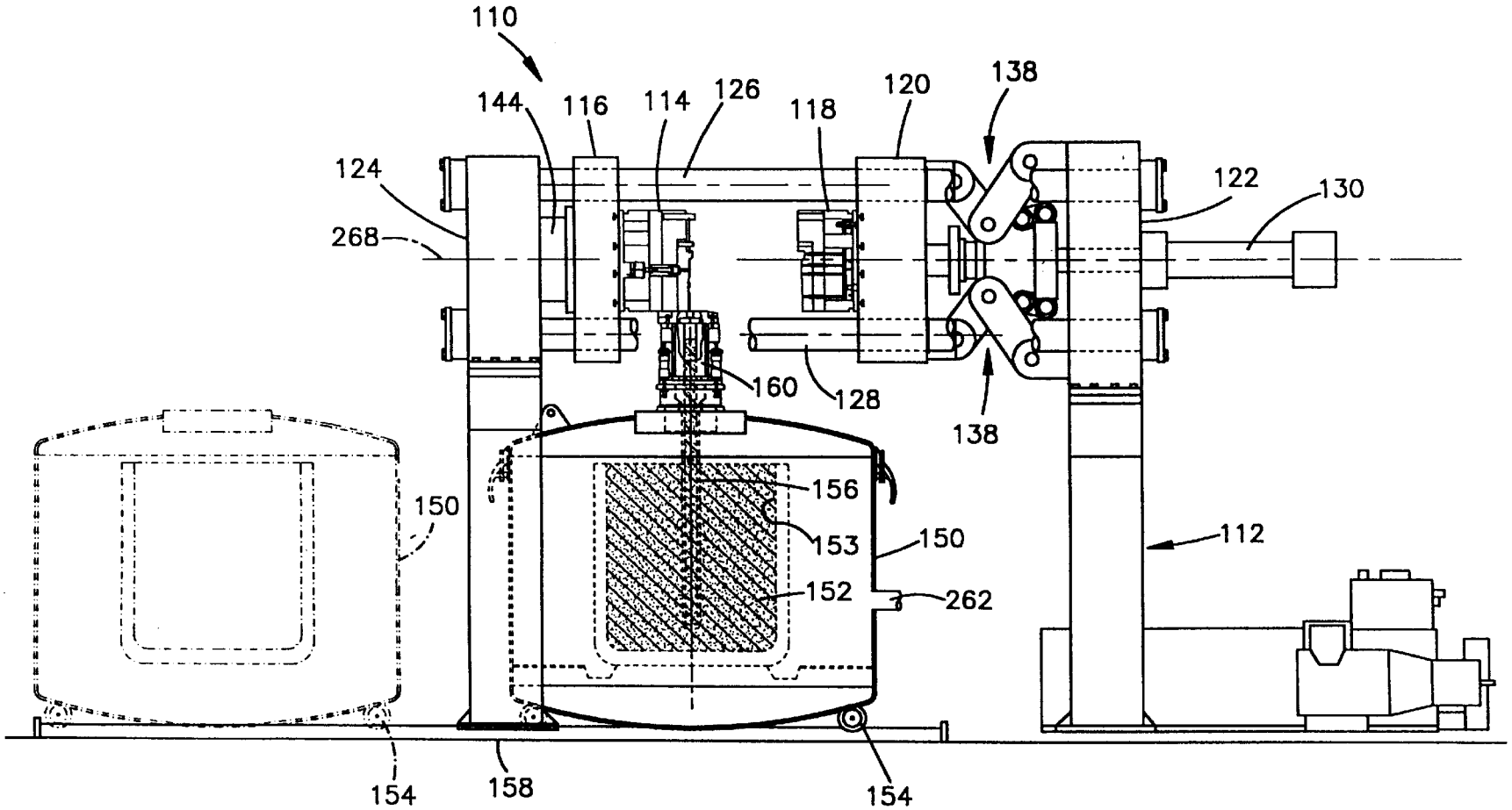
FIG. 10 is a view similar to FIG. 9 illustrating the die assembly in its open position.

FIGS. 9–20 disclose a further embodiment of the invention which provides an extremely simple, low cost squeeze casting apparatus 110. Referring particularly to FIGS. 9 and 10, a squeeze casting apparatus 110 is illustrated which includes a die assembly including a first male die member 114 and a second female die member 118. The male die member 114 is supported for movement on a first platen 116 and the female die member 118 is supported for movement on a second platen 120. The die assembly 111 is operable to move between its closed position illustrated in FIG. 9 in which the first die member 114 engages with the second die member 118 to define an interior cavity 168 therein and its opened position illustrated in FIG. 10 in which the male die member 114 is spaced apart from the female die member 118.

The squeeze casting apparatus 110 includes a frame 112 having a pair of vertical upright portions 122 and 124 which support horizontal guide members 126, 128 therebetween. The first and second platens 116 and 120 are supported on the guide members 126 and 128 for movement between their positions illustrated in FIGS. 9 and 10.

A hydraulic cylinder assembly 130 is supported on the vertical portion 122 of the frame 112 and includes a piston 136 moveable in response to energization of the hydraulic cylinder 130. The piston 136 is connected to a linkage 138 by the pivot pins 134 connected to the piston 136. The linkage is an overcenter linkage and is connected to platen 120 to effect movement thereof. Movement of the piston 136 from its position illustrated in FIG. 10 to its position illustrated in FIG. 6 affects movement of the linkage 138 to move platen 120 and the die member 118 supported thereon between its position illustrated in FIG. 10 and its position illustrated in FIG. 9. An ejector mechanism 140 including the ejector cylinder 142 is supported on platen 120 for ejecting articles which have been cast from the female die member 118.

A densifying assembly 144 is connected between the vertical portion 124 of the frame 112 and the first platen 116. The densifying assembly 144 is operable to move the platen 116 and die member 114 to reduce the volume of the interior cavity after the first and second die members 114 and 116 are moved to their closed position, the interior cavity is filled with molten material and the cavity is sealed to squeeze cast an article. The densifying assembly 144, the hydraulic cylinder assembly 130 and the die members 114, 118 are all located on the horizontal centerline 268 of the squeeze casting apparatus to ensure the application of linear forces on the die assembly 111 to prevent cocking of die member 114 relative to die member 118. In addition, the interior cavity can also be located on the centerline 250 of the die assembly 111.

A low pressure furnace 150 is provided to provide a supply of molten metallic material 152 for squeeze casting an article. The furnace 150 is operable to be moved between its full line position, illustrated in FIG. 6, in which the furnace 150 is operable to provide a source of molten metallic material 152 for squeeze casting an article to its position shown in phantom lines in FIG. 6 in which the furnace can be replaced, refilled with a source of molten metallic material or other material or have maintenance performed thereon. While the furnace 150 is described as providing a supply of molten metallic material, it should be appreciated that other molten materials such as plastics could be utilized within the furnace 150 to provide a low pressure supply of molten material for squeeze casting or for regular casting. The furnace 150 is moveable on a plurality of wheels 154 which support the furnace on a track 158, and allow the furnace to be moved between its phantom line and full line position illustrated in FIG. 6.

The furnace 150 includes a stocktube 156 which is connected to a manifold assembly 160 which is adapted to be placed in fluid communication with the interior cavity 168 or cavities formed in the die assembly. A source of low pressure gas 262 is provided to pressurize the low pressure furnace 150. The gas fills the low pressure furnace and exerts pressure on the top of the molten metallic material disposed in chamber or crucible 153 to cause the molten material to flow from the furnace 150. As used herein, the term low pressure means less than 20 psi pressure. When the furnace 150 is pressurized, fluid pressure is introduced into the furnace with a sufficient pressure to force the molten metallic material to flow under low pressure upwardly through the stocktube 156 to the manifold assembly 160 where it is introduced into the interior cavity 168 formed between the die members 114, 118.

Figure 17:
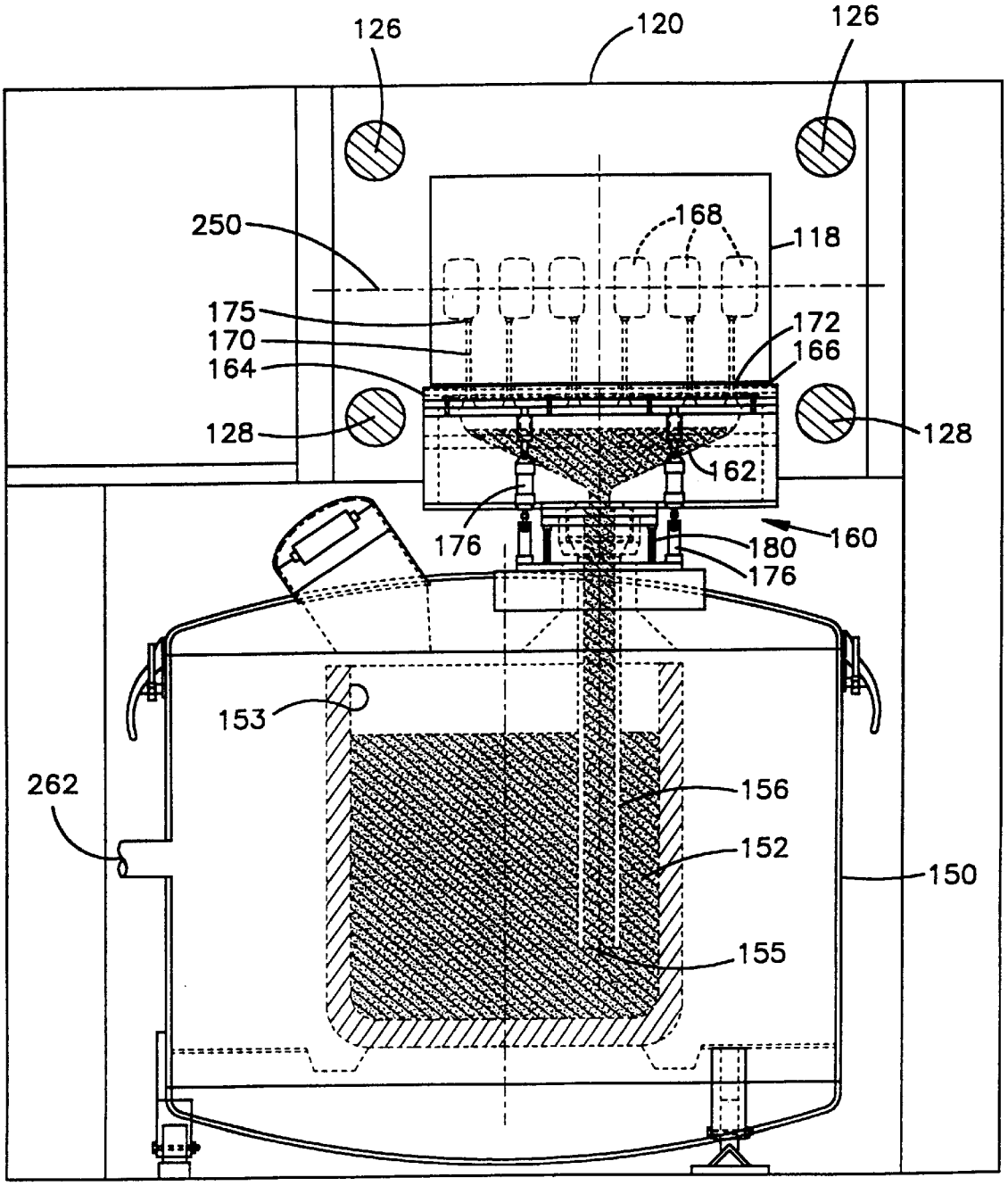
FIG. 17 is a side schematic illustration of the furnace in position to fill a die assembly having multiple cavities.
Figure 18:
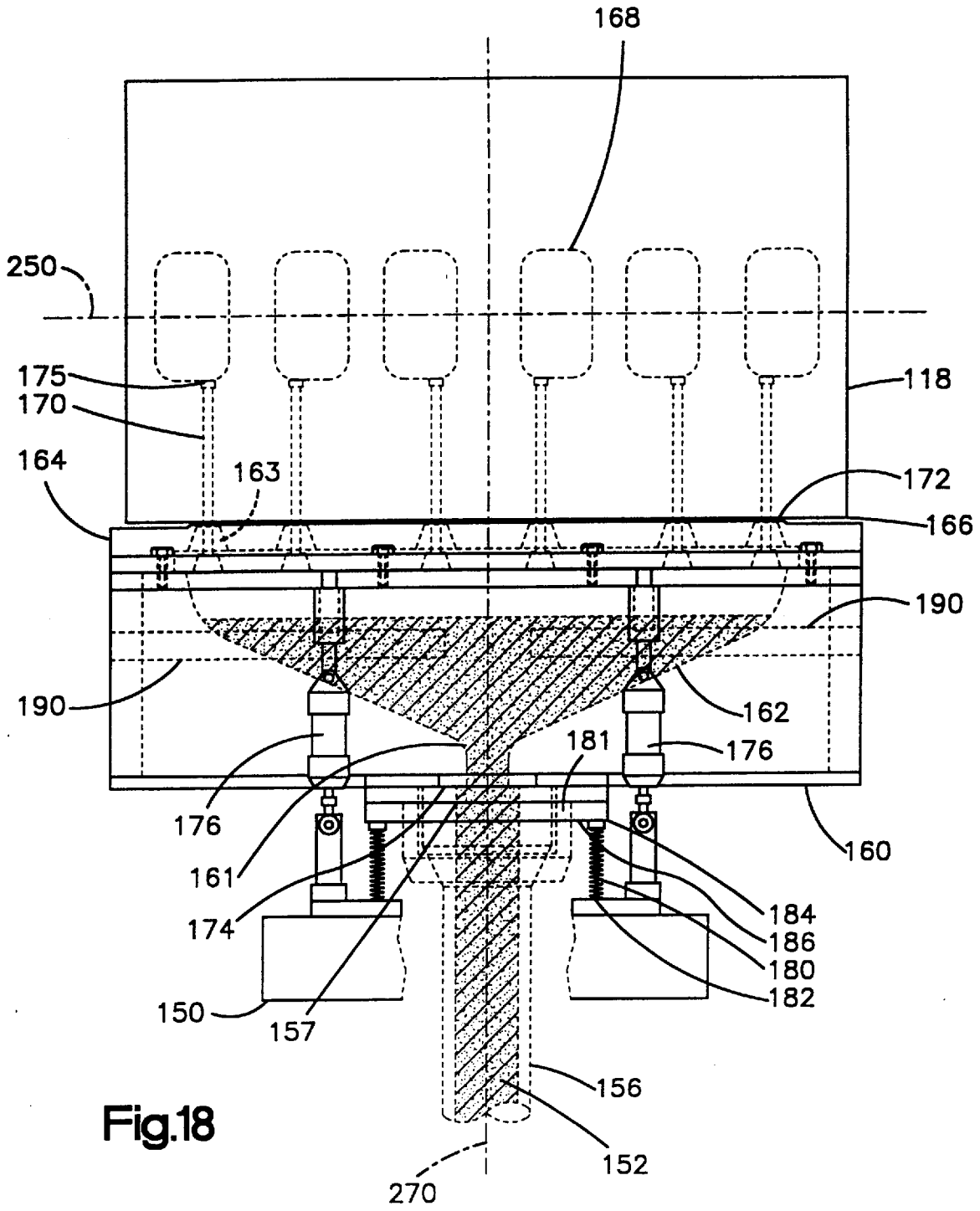
FIG. 18 is a fragmentary side view illustrating the manifold assembly in engagement with the bottom portion of the die assembly to provide fluid communication between the outlet from the manifold assembly and the inlet to each of the runners in the die assembly.
Figure 19:
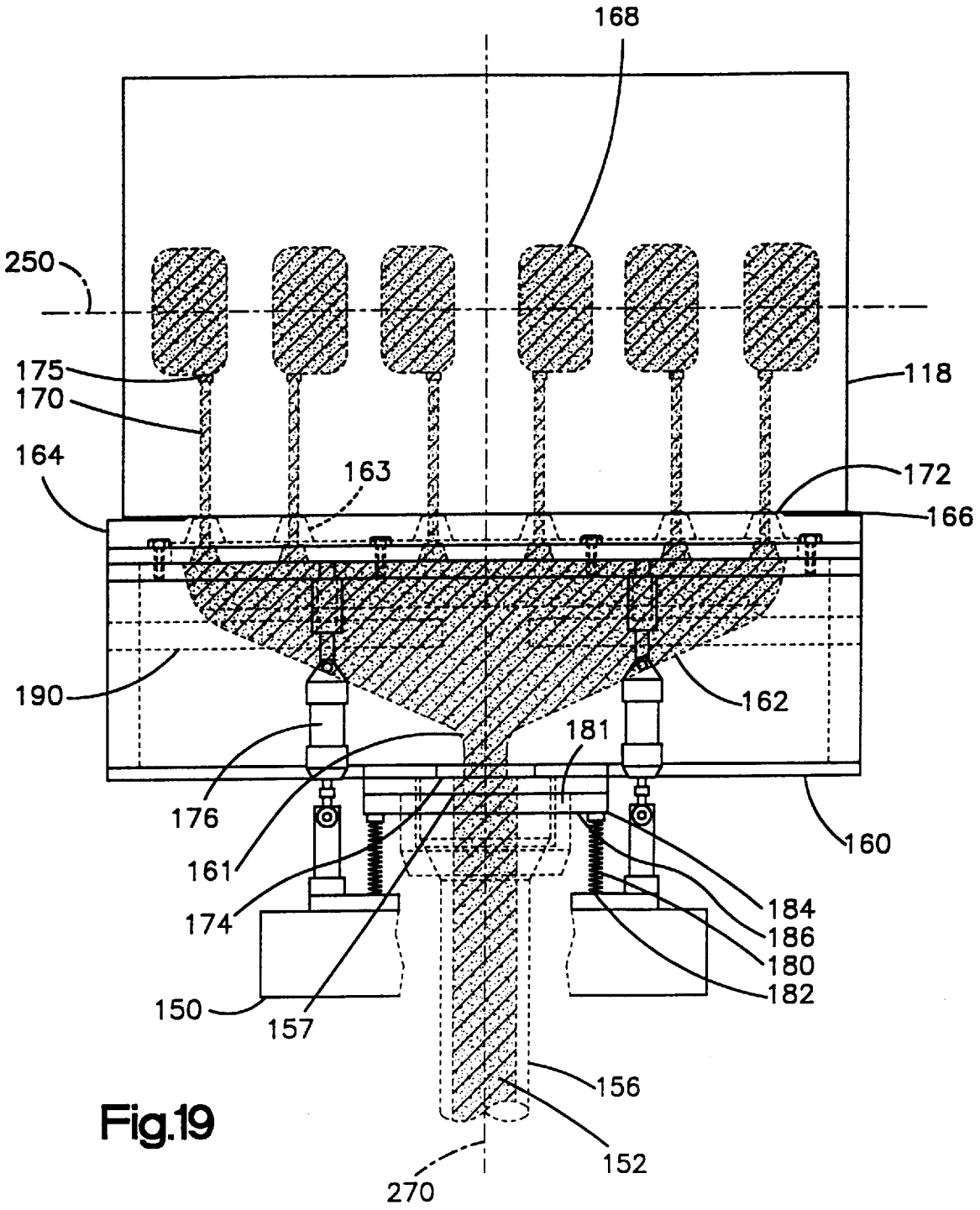
FIG. 19 is a view similar to FIG. 18 illustrating molten metallic material filling the manifold, runners and interior cavities when the furnace is pressurized.
Figure 20:
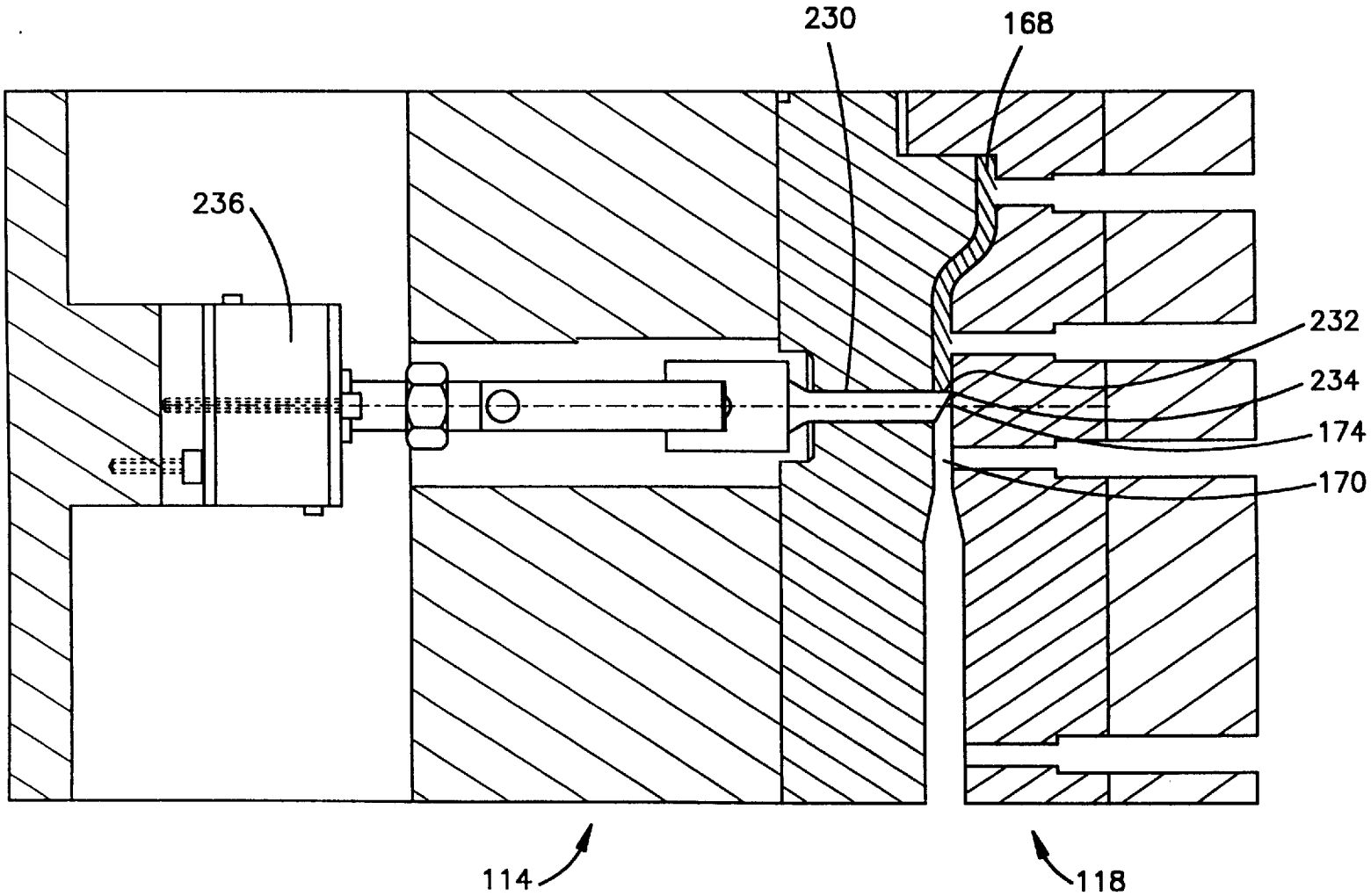
FIG. 20 is an enlarged fragmentary view more fully illustrating the shut-off element in its extended position in which the shut-off element seals the interior cavity at the juncture of the interior cavity and the runner and forms a portion of the interior cavity.

The furnace 150, as is more fully illustrated in FIGS. 17–19, includes the manifold assembly 160 having an manifold 162 therein for receiving molten metallic material from the stocktube 156. The stocktube 156 includes an inlet 155 and an outlet 157 which is sealed and connected to an inlet 161 of the manifold assembly 160 at 174. The manifold assembly 160 includes an adaptor plate 164 including a plurality of manifold outlets 163 therein which are adapted to be placed in fluid communication with inlets to the runners for filling the interior cavities 168. A plurality of heaters 190 can be provided in the manifold assembly 160 to heat the molten metallic material disposed in the manifold 162 to insure that the molten metallic material is at a predetermined temperature when it is introduced into the interior cavities 168. The heaters 190 prevent the formation of surface oxide on molten metallic material in the manifold 162 and prevent the molten metallic material from cooling before being introduced into the cavities 168.

As is illustrated in FIG. 17, a plurality of interior cavities 168 may be formed between the die members 114 and 118. The interior cavities 168 which are shaped to form an article to be cast each include a runner 170 having a generally vertical orientation connected thereto. Each of the runners 170 includes an inlet 172 located on a bottom surface 166 of the die assembly 111 and an outlet 175 located at the juncture of the interior cavity 168 and runner 170. Each of the runners 170 is adapted to be placed in fluid communication with one of the outlets 163 from the manifold 162 which are disposed in the adaptor plate 164. The area of the openings 163 in the adaptor plate 164 is less than the area of the inlets 172 to the runners 170. It should be apparent that the adaptor plate 164 can be replaced when the die members 114 and 118 are replaced to enable the manifold assembly 160 to communicate with runners having various locations on the bottom surface 166 of the die assembly.

As is illustrated in FIGS. 17–19, the cavities 168 are all located on the horizontal centerline 250 of the die assembly 111 formed from the die members 114–118 and the centerline 250 is also the centerline of each of the platens 116, 120. All of the cavities 168 are located the same vertical distance above the bottom surface 166 of the die assembly 111 and all of the runners 170 are of substantially identical length and volume and have a generally vertical orientation. Locating the die cavities 168 on the centerline of the die assembly 111 and the platen 116, 120 provides for precise, repeatable registration of the die members 114, 118 and uniform squeeze casting without cocking of one of the die members 114 and its platen 116 relative to the other die member 118 and platen 120. By locating the die cavities 168, a uniform vertical distance above the bottom surface 166 of the die assembly 111 and by having all of the runners 170 of identical length and volume, each of the cavities 168 can be uniformly filled at the same time by the manifold assembly 160 injecting an equal volume of molten metallic material through each of the runners 170 to uniformly fill each of the die cavities 168 simultaneously.

A plurality of cylinders 176 are interposed between the manifold assembly 160 and the top of the furnace 150 for biasing and moving the manifold assembly 160 in a upwardly direction to affect engagement of the adaptor plate 164 with the bottom surface 166 of the die assembly 111 under the application of the uniform pressure. When it is desired to move the furnace 150 from its phantom line position illustrated in FIG. 9 to its full line position illustrated in FIG. 9, the furnace 150 is moved along tracks 158 until it is in a position located beneath the parting line 117 of the die members 114, 118. When the furnace 150 is moved to its full line position illustrated in FIGS. 9 and 10, the cylinders 176 are energized to raise the manifold assembly 160 from a retracted position, not illustrated, in which the adaptor plate 164 is spaced apart from the bottom surface 166 of die assembly, to an extended position in which the adaptor plate 164 engages with the bottom surface 166 of the die assembly 111. In this position, each of the outlets or openings 163 in the adaptor plate will be in fluid communication with one of the inlets 172 of one of runners 170 to each of the interior cavities 168. The cylinders 176 are continuously energized to bias the manifold assembly 160 in an upwardly direction when the furnace 150 is in its fulline position illustrated in FIGS. 9 and 10. Both the manifold assembly 160 and stocktube 156 are connected together at 174 and move in a vertical direction as a unit when cylinders 176 are energized. While cylinders 176 are illustrated in the preferred embodiment of the invention, a spring or plurality of springs could replace cylinders 176 to bias the manifold assembly 160 in an upwardly direction.

A flexible conduit means 180 surrounds the stocktube 156 and is sealed and connected at 182 to the top portion of the furnace 150 and at 184 to the bottom of the manifold assembly 160. The flexible conduit means 180 surrounds stocktube 156 where stocktube 156 passes through opening 181 in the top of the furnace 150 and allows the stocktube 156 and manifold assembly 160 to move relative to the furnace 150 without gas leakage from the furnace while providing a fluid-type connection between the furnace 150, stocktube 156 and manifold assembly 160. The cylinders 176 exert a pressure of approximately 5–10 psi to bias the manifold assembly 160 into engagement with the bottom surface 166 of the die assembly 111.

When the low pressure furnace 150 is pressurized to not more than 20 psi molten metallic material 152 flows from chamber 153 in a upwardly direction through the stocktube 156 to an inlet 161 to the manifold 162 in the manifold assembly 160. The manifold 162 then fills with molten metallic material and the molten metallic material then flows through the outlets 163 in adaptor plate 164 into the runners 170 to uniformly fill interior cavities 168 simultaneously.

When the low pressure furnace 150 is pressurized to approximately 20 psi the pressure flows through opening 181 in the top of furnace 150 and into the flexible conduit means 180 and exerts a pressure against the surface 186 on a support plate 188 which is connected to the bottom of the manifold assembly 160. The pressure exerted on surface 186 by the pressurized gas biases the manifold assembly 160 in an upwardly direction to further bias adaptor plate 164 into engagement with the bottom surface 166 of the die assembly 111. The additional biasing of the manifold assembly 160 by the pressurized gas in the furnace 150 further insures a fluid-tight connection between the outlets 163 from the manifold 162 to the inlets 172 of the runners 170 located on the bottom surface 166 of the die assembly. The use of the pressure in the furnace 150 to maintain contact between the manifold assembly 160 and the bottom 166 of die assembly 111 offsets any pressure created in the die assembly 111 by the flow of molten metallic material into cavities 168. The area of the surface 186 on which the pressure in the furnace acts to bias manifold assembly 162 in an upwardly direction should be greater than the cross-sectional area of the parts to be cast and the runners 170 taken along a horizontal axis parallel to surface 186 to insure that the pressure in the furnace acting on surface 186 establishes an upward force on manifold assembly 160 which is greater than the downward separation forces caused by the pressure of the molten metallic material in the cavities 168 and the runner 170 on the adapter plate 164.

The pressure in the furnace 150 is held at approximately 5 psi to hold molten metallic material in the manifold 162 as is illustrated in FIG. 18 and can be increased up to 20 psi to flow the molten metallic material through the manifold 162 to fill cavities 168 as is illustrated in FIG. 19. The pressure exerted on surface 186 increases as molten material flows into the cavities 168 from the stocktube 156 and manifold 162. Thus, when it is desired to increase the pressure in the furnace 150 and flow molten metallic material therefrom to fill cavities 168, the pressure on surface 186 increases to further bias the manifold assembly 160 into engagement with the bottom surface 166 of the die assembly. When pressure is reduced in furnace 150 and molten metallic material no longer flows into the runners 170 to fill cavities 168, the pressure on surface 186 is reduced and the biasing effect of the pressurized gas in the furnace 150 is reduced on manifold assembly 160 to reduce the biasing of the manifold assembly 160 against the bottom surface 166 of the die assembly 111 to facilitate sliding movement between the die members 114 and 118 and the adaptor plate 164. When pressure in the furnace 150 is reduced the pistons 176 will continue to bias the manifold assembly 160 in an upwardly direction against the surface 166 of the die assembly. In practice, it has been found that when the pressure in the furnace 150 increases to flow metal from the furnace 150 to the cavities 168, the upward force exerted on the manifold assembly 160 is approximately 1.2 times the pressure acting on adaptor plate 164 from the pressure contained in the runners 170. The force acting on the manifold 160 biases manifold assembly 160 and stocktube 156 upwardly and effects a fluid tight engagement between the adaptor plate 164 and the bottom surface 166 of the die assembly 111.

FIGS. 11–16 illustrate the sequential movement of the platens 116, 120 and the die members 114, 118 to cast an article. As is more fully disclosed in FIG. 11, the die assembly 111 includes male die member 114 and female die member 118. The male die member 114 includes at least a single die insert 194 therein which in part defines the article to be cast and in part defines the interior chamber 168 when the die members 114 and 118 are in their closed position. The female die member 118 includes an insert 196 which cooperates with die member 114 to in part define the cavity 168 in which an article is to be cast. As has been previously indicated, more than one cavity 168 may be defined between the die members 114, 118 to cast multiple articles. The male die member 114 includes a plurality of cylindrical guide members 198, 200 and 202 which are adapted to register with and to slide within cylindrical guideways 204, 206 and 208, respectively, in the female die member 118 to provide for precise registration of the female die member 118 relative to the male die member 114.

The male die member 114 is connected to the first platen 116 by a spacer member 210 which is secured within suitable keyways 212 located on platen 116. The spacer member 210 supports the male die member 114 on the platen 116 and provides passageways for air flow around the male die member 114 to prevent overheating thereof and to distribute heat from the squeeze casting process through the die member 114 and platen 116.

The female die member 118 is supported on platen 120 by a support plate 214 which is suitably keyed at the keyways 216 to the moveable platen 120. Support member 214 functions in a manner similar to support member 210 to support die member 118 for movement with platen 120 and to distribute heat from the squeeze casting process.

Figure 11:
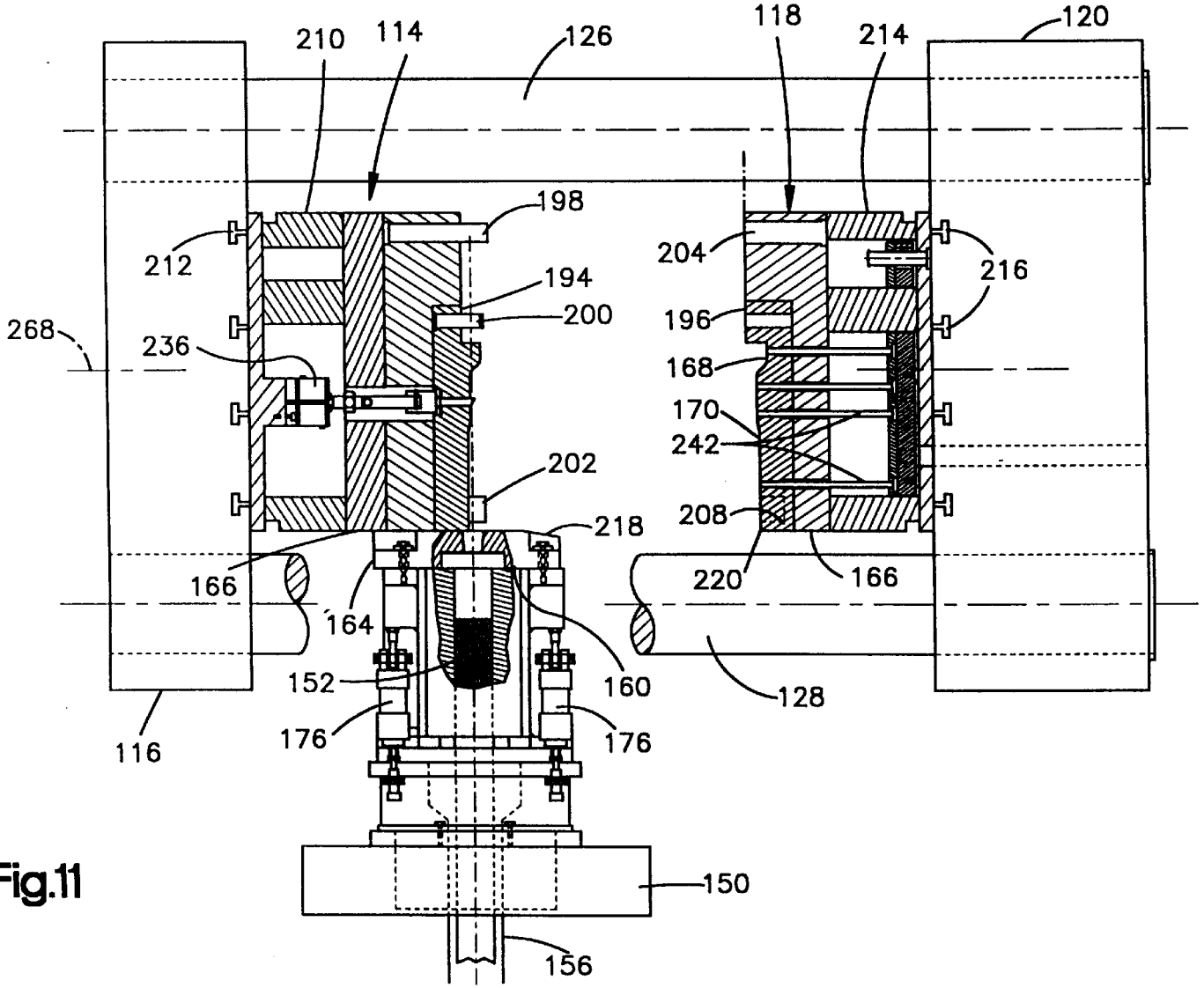
FIG. 11 is an enlarged fragmentary view of the die assembly in its open position and illustrating the manifold assembly of the low pressure furnace in position to fill the die assembly.

When the die members 114 and 116 are in their open position as is illustrated in FIG. 11, the adaptor plate 164 of furnace 150 will be biased into the bottom surface 166 of die member 114 of the die assembly 111 by the fluid cylinders 176. In this position, the adaptor plate 164 will be positioned to be in fluid communication with the runners 170 when the die assembly 111 is in its closed position. While the runner 170 has been illustrated as being in the female die member 118, it should be apparent that the runner 170 is preferably formed on both male die member 114 and female die member 118.

Figure 12:
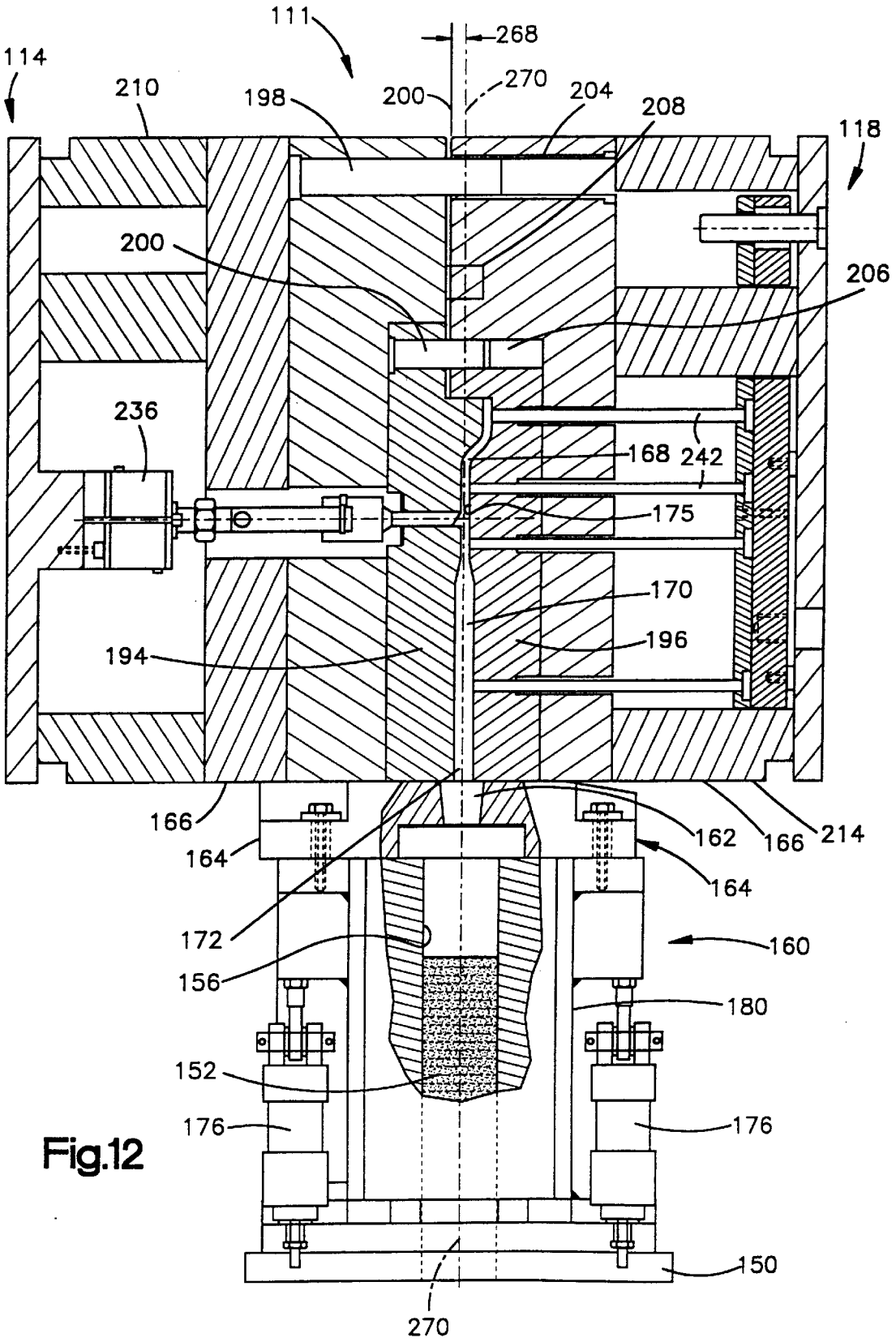
FIG. 12 is a view similar view to FIG. 11 illustrating the die assembly in its closed position.

The hydraulic cylinder 130 is energized to move linkages 138 to their straight line position illustrated in FIG. 9 to move the die member 118 from its position illustrated in FIG. 11 to its position illustrated in FIG. 12 in which the female die member 118 engages with the male die member 114 to, in part, define the interior cavity 168. As die member 118 moves toward die member 114, the cylindrical guide members 198, 200 and 202 slide within the cylindrical guideways 204, 206 and 208 to precisely register the male die member 114 relative to the female die member 118. The movement of the linkage 138 to its straight line on center locking position locks linkages 137 and 139 in place and precisely sets the location of platen 120 and female die member 118 relative to platen 116 and male die member 114 with repeatability and precision.

When the female die member 118 moves to its position illustrated in FIG. 12, the bottom surface 166 of the die member 118 slidingly engages with the top surface of the adaptor plate 164 of the manifold assembly 160. The manifold assembly 160 includes a ramped surface 218 to facilitate sliding engagement of the bottom 166 of the female die member 118 and the adaptor plate 164. It is preferable that the leading edge 220 of the die member 118 be slightly rounded to facilitate movement of the die member 118 along ramped surface 218 relative to the adaptor plate 164. It should be appreciated that when the die member 118 slides over the adaptor plate 164, the adaptor plate 164 is continuously being biased in an upwardly direction by the cylinders 176 but is not being significantly biased upwardly by the reduced gas pressure in the furnace. When the die member 118 is moved to its position illustrated in FIG. 12, the runners 170 for each of the interior cavities 168 are aligned with associate openings 163 in the adaptor plate 164 of the manifold assembly 160.

The verticle centerline 270 of the stocktube 156 and manifold assembly 160 is offset with respect to the parting line 117 of die assembly 111 to prevent cocking of the manifold assembly 160 relative to the bottom surface 166 of the die assembly. It is desirable to maintain contact between the bottom surface 166 of die member 114 and the top of the manifold assembly over a greater surface area then the contact between the bottom surface 166 of die member 118 and the top of the manifold assembly 160 to keep the top surface of the manifold assembly flat and true relative to surface 166. Since the movement of the male die member 114 relative to the manifold assembly is small, a large area of contact between the bottom 166 of die member 114 and manifold assembly can be continuously maintained. When female die member 118 moves to its open position, it leaves engagement with the top surface of manifold assembly 160. Thus, to keep the manifold assembly 160 from cocking, the male die member 114 preferably engages more than half of the tope of the manifold assembly and preferably at least two times the surface areas on the top of the manifold assembly 160 as the female die member 118 when the die members are in their closed position. The ramped surface 218 does not entirely engage the bottom of die member 118 as the surface is ramped away from the bottom surface 166 of die member 118. This further decreases the surface area of the top of the manifold assembly 160 which engages with the bottom of female die member 118 when the die members are in their closed position.

When the die member 118 is moved to its position illustrated in FIG. 12, the pressure in the furnace 150 can be increased to flow molten metallic material from the furnace 150 through the stocktube 156 to the manifold assembly 160, through the outlets 163 from the manifold assembly 160 into the runner 170 to fill the interior cavity 168.

An elongate shutoff member 230 is supported by the male die member 114 to seal interior cavity 168 after the interior cavity has been filled with molten metallic material. The shutoff member, more fully illustrated in FIG. 20, includes a pointed-end portion 234 and a surface 232 which in part defines the interior cavity 168 and the article to be cast. A cylinder assembly 236 is provided to move shutoff member 230 from its retracted position illustrated in FIG. 13 to its extended position illustrated in FIG. 14 and FIG. 20. After the cavity 168 is completely filled with molten metallic material, the shut-off element 230 is moved to its extended position illustrated in FIG. 14 and 20 to seal the molten metallic material in the interior cavity 168 at the juncture of the cavity 168 and runner 170 and to position surface 232 to in part define cavity 168. After shutoff member 230 is moved to its extended position to seal cavity 168 the pressure in low pressure furnace 150 is reduced and any molten metallic material in the runner 170 drains under the influence of gravity from runner 170 back into the manifold 162 and to the stocktube 156 where it is reheated for further use. The shutoff member 230 seals the cavity 168 at the outlet 175 of the runner 170, i.e. at the juncture of cavity 168 and runner 170, and allows any molten metallic material which is not being used to cast the article to drain back for reuse thereby increasing the efficiency of the molding process with increased yields per volume of metal heated and cast.

Figure 15:
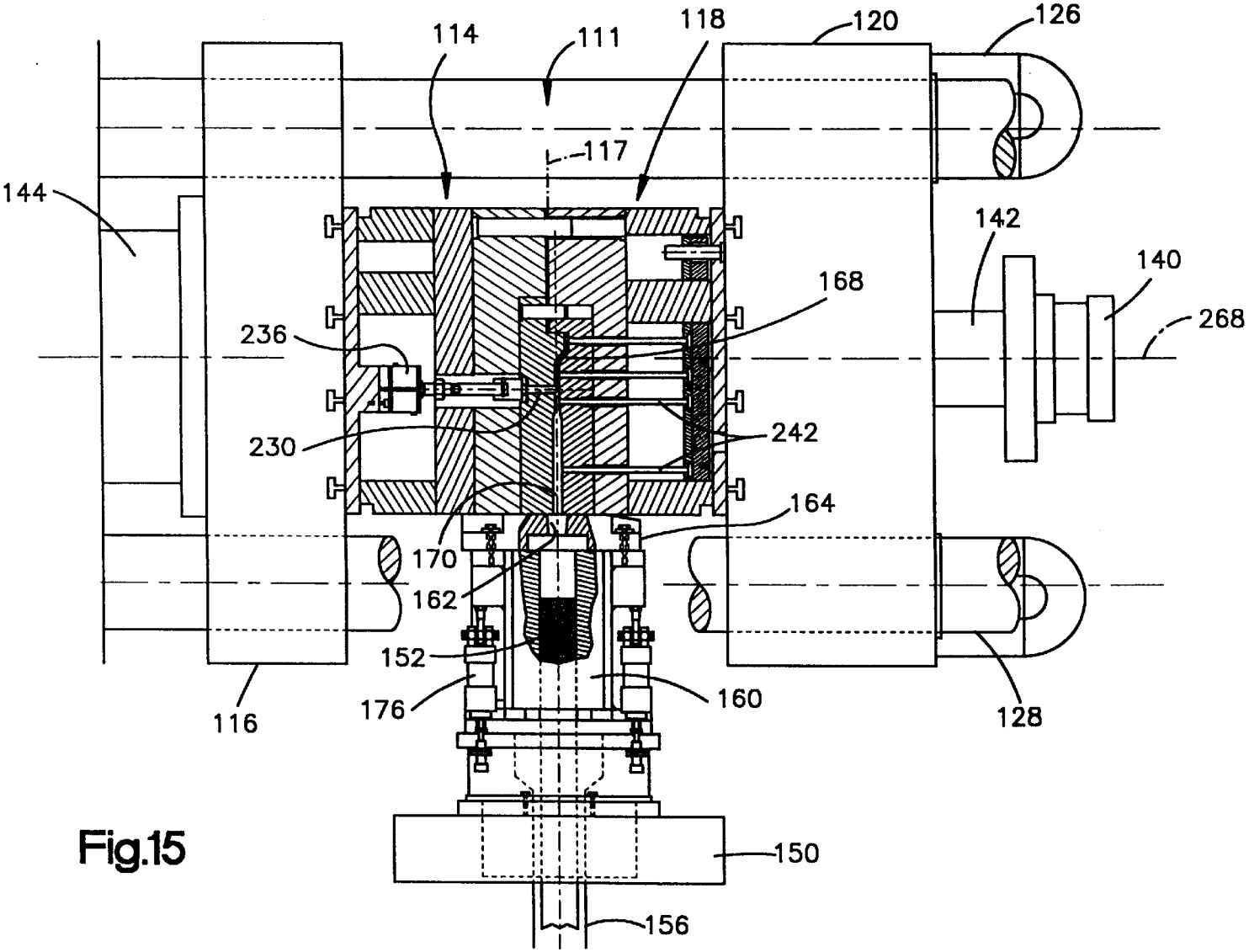
FIG. 15 is a side view of the die assembly similar to FIG. 11 illustrating movement of the densifying cylinder and first die assembly to reduce the volume of the interior cavity and squeeze cast the article to be formed.

After the cavity 168 is filled with molten metallic material and shut-off element 230 is extended to seal cavity 168, the densifying assembly 144 is energized to move platen 116 to the right as is illustrated in FIG. 15 to move male die member 114 to reduce the volume of the interior cavity 168 to squeeze cast an article therein. In the preferred embodiment of the invention, the densifying cylinder moves platen 116 and male die member 114 approximately 0.025 inches to the right between its position illustrated in FIG. 14 and its position illustrated in FIG. 15 to reduce the volume of the interior cavity 168 an amount equal to the shrinkage of the material to be cast and squeeze cast an article therein.

The densifying assembly 144 includes a densifying cylinder, not illustrated, which effects movement of the platen 116 when the densifying cylinder is energized. The densifying cylinder can act as a stop member for the platen 116 and male die member 114 to precisely position the male die member 114 in its retracted position, illustrated in FIG. 14.

Figure 13:
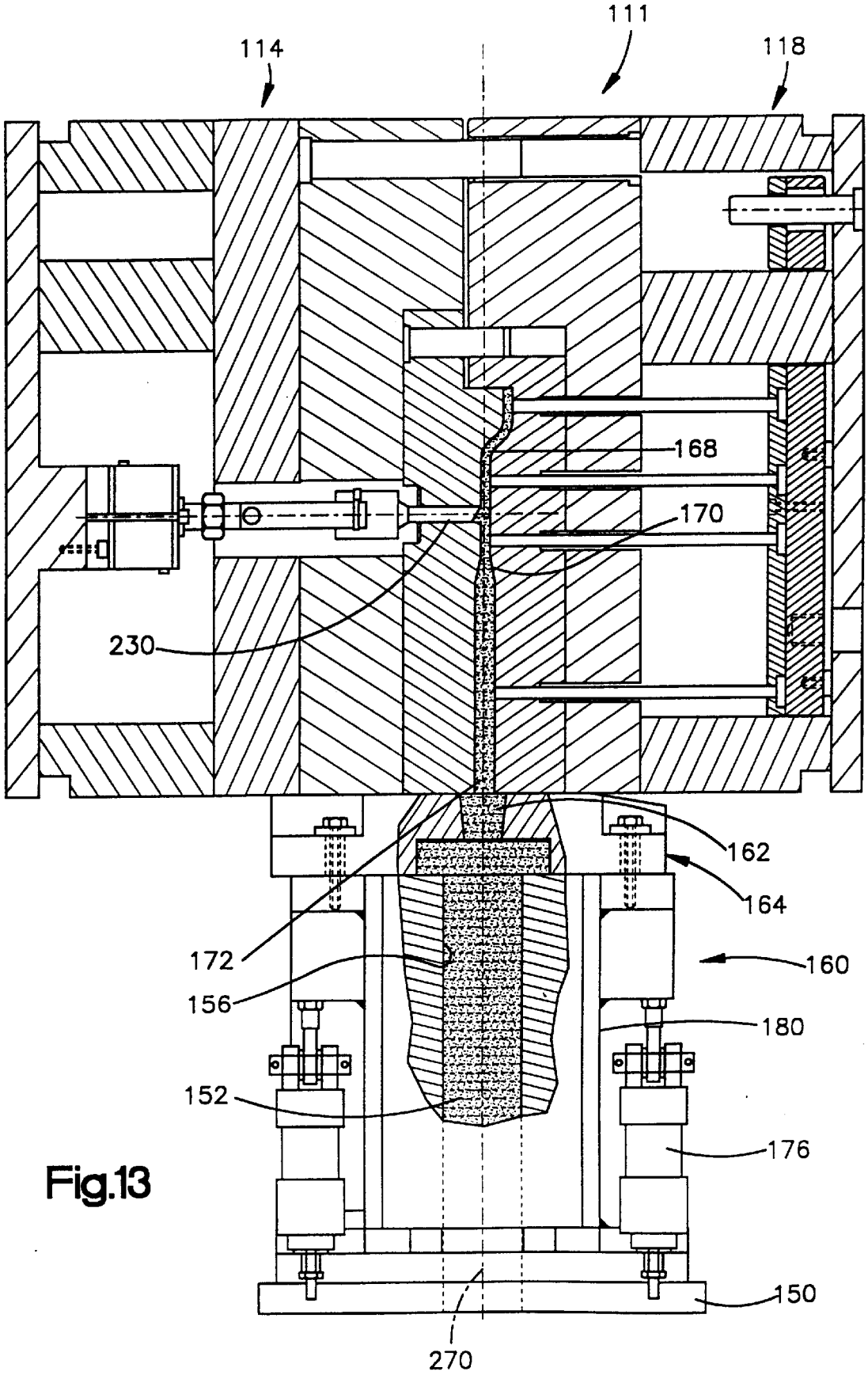
FIG. 13 is a side view of the die assembly similar to FIG. 12 illustrating the filling of the interior cavity by molten metallic material flowing from the manifold through the runner to the interior cavity.
Figure 14:
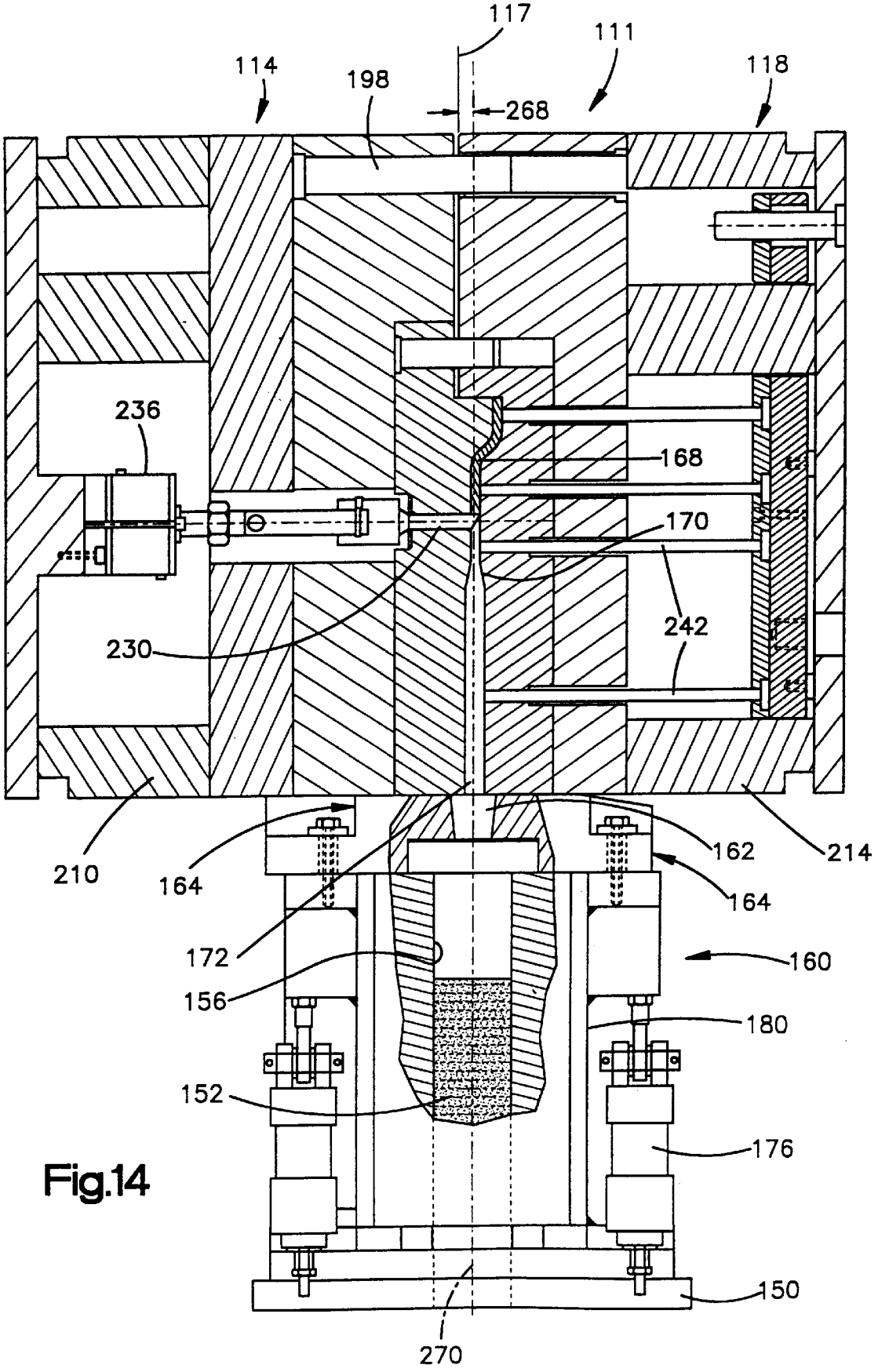
FIG. 14 is a side view of the die assembly similar to FIG. 13 illustrating the shutoff member in its extended position and the pressure in the furnace reduced to allow molten material to drain from the runner back into the furnace via the runner and stocktube.
Figure 16:
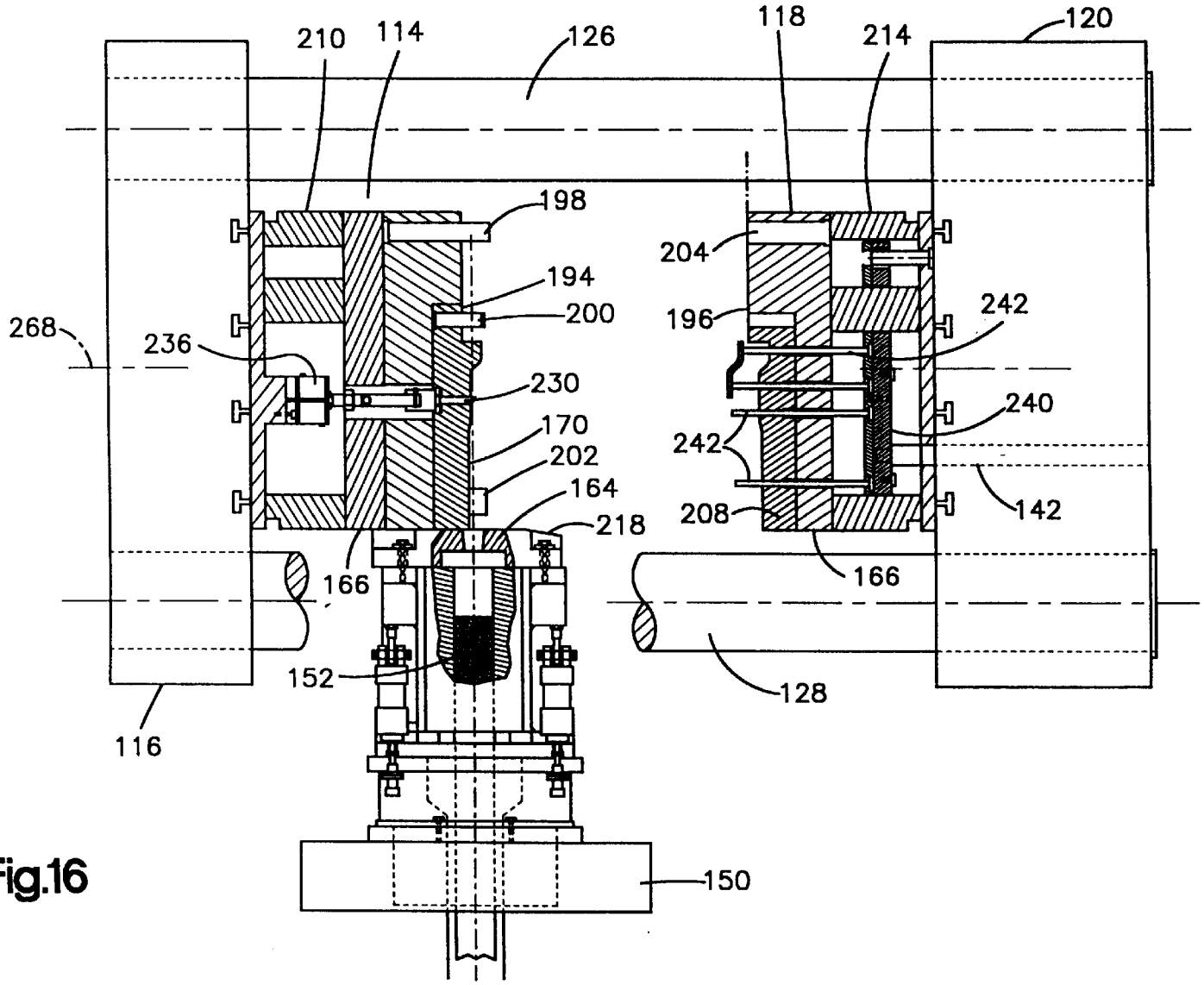
FIG. 16 is a view similar to FIG. 15 illustrating the die assembly in its open position and the article being ejected from the female die member.

After the article is densified by squeeze casting as is illustrated in FIG. 15, the densifying assembly 144 is retracted to slightly move the platen 116 and male die member 114 to the left to its position illustrated in FIG. 13 and the hydraulic cylinder 130 is energized to retract piston 136 to move linkages 138 to their position illustrated in FIG. 10 in which the die member 118 is spaced apart from the die member 114. The article cast in cavity 168 is then ejected from the cavity 168 by energizing the ejection mechanism 140 which is associated with the female die member 118. Energization of ejection mechanism 140 moves rods 142 to the left as is illustrated in FIG. 16. Rods 142 engage an ejector plate 240 supported in the female die member 118. Ejector plate 240 is connected to the ejector pins 242 which then move outwardly from die member 118 to eject any article in cavity 168 and to eject any residue remaining in runner 170.

It should be appreciated that a new improved die casting apparatus 110 has been disclosed which utilizes a substantially simplified structure. In the present embodiment, the die casting apparatus 110 includes a male die member 114 supported for densification movement on a first platen 116 by a densifying assembly 144 and a female die member 118 supported for movement on a second platen 120. The ejector mechanism is supported for movement with the second platen 120 and the female die member 118. The densifying assembly 144 is associated with the first platen 116 and with the male die member 114. Such a construction substantially simplifies the construction of the tooling by providing a movable male die member 114 associated with the densification assembly 144 and by providing for densification movement of the male die assembly 114 with the platen 116. This is a distinct improvement over prior art densification assemblies which include densification members which are part of the tooling. The male die member 114, due to the fact that it is only moved for densification purposes, moves only a very small distance. Such a construction simplifies the use of multi-cavity tooling and the construction of male die member 114. Warpage and expansion is minimized by the use of the support members 210 and 214 to support die members 114 and 118 on platens 116 and 120, respectively. By using the densifying assembly 144 to move only the male die member 114 and platen 116 and by placing the ejector mechanism 140 on the platen 120 associated with the female die member 118 the complexity of the present squeeze casting apparatus is reduced which allows the use of large guide rods 126 and 128 to support platens 116 and 120 for linear movement in a horizontal direction. In addition, the location of die assembly 111, densifying assembly 144 and hydraulic cylinder 130 on centerline 266 prevents cocking of die members 114, 118 and uneven pressurization of cavities 168.

From the foregoing it should be apparent that a new and improved apparatus and method for squeeze casting an article and a low pressure furnace 150 for cooperating with the casting apparatus has been disclosed.

The squeeze casting apparatus includes a first platen 116, a male die member 114 supported for movement therewith, a second platen 120, a female die member 118 supported for movement with the second platen and an ejector mechanism 140 including at least a single ejector pin for ejecting a cast article from the female die member. The second platen is movable between an open position in which the female die member 118 is spaced apart from the male die member 114 and a closed position in which the female die member engages the male die member to define in part an interior cavity 168 for receiving molten metallic material to cast an article therein. The first platen and male die member 114 are movable toward the second platen 120 and female die member 118 to reduce the volume of the interior cavity and squeeze cast an article therein. Densifying means 144 are provided for moving the first and second platens to densify the molten metallic material in the interior cavity.

The method includes a method of squeeze casting an article including moving the first and second platens 116 and 120 and associated die members 114 and 118 relative to each other from an open position to a closed position to in part define the interior cavity 168, flowing molten metallic material through the runner 170 to the interior cavity 168, filling the interior cavity 168 with molten material, moving a shutoff member 230 into its sealing position when the interior cavity is filled with molten material to seal the interior cavity at the juncture of the runner 170 and the interior cavity 168 and to position the surface 232 of the shutoff member 230 to define a portion of the interior cavity 168 and densifying the molten material in the cavity by reducing the volume of the interior cavity.

The method of casting further includes the steps of locating a furnace having a manifold assembly in position to communicate with the inlet to the runner 170, moving the first and second die members 114, 118 from an open position to a closed position in which the runner is positioned in fluid communication with the outlet from the manifold assembly 160, pressurizing the furnace with a supply of low pressure gas 262 with sufficient pressure to flow the molten material through the stocktube 156 to the manifold assembly 160 to fill the interior cavity 168 with molten material and biasing the outlet of the manifold assembly into sealing fluid tight engagement with the inlet to the runner with the pressure from the low pressure gas in the furnace.

The low pressure furnace 150 includes a chamber 153 having a supply of molten metallic material 152 therein, a stocktube 156 having an inlet 155 and an outlet 157, a low pressure gas supply 262 communicating with the chamber 151 at a location above the top surface of the molten metallic material to establish sufficient pressure in the chamber to flow molten metallic material through the stocktube. The manifold assembly 160 has an outlet 163 adapted to be placed in fluid communication with the inlet 172 to the runner 170 on the die assembly 111 and an inlet 161 in fluid communication with the outlet 157 of the stocktube. The manifold assembly is movable in a verticle direction from a retracted position to an extended position in which the manifold assembly 160 is engaged with a lower portion of the die assembly 111 and the outlets 163 of the manifold assembly are in fluid communication with the runners 170. Flexible conduit means is disposed between the manifold assembly 160 and the chamber to provide a flexible fluid tight connection between the chamber and the manifold assembly which enables the manifold assembly to move relative to the chamber without leakage of low pressure gas from the furnace 150. Biasing means are provided for biasing the manifold assembly 160 and the flexible conduit means into engagement with a lower portion of the die assembly 111 and to provide a sealed connection between the outlet of the manifold assembly 160 and the inlet to the runner 170. The biasing means includes the cylinders 176 and also includes the low pressure gas supply 262 which exerts a biasing pressure against the manifold assembly 160 to bias the manifold assembly 160 in an upwardly direction into engagement with the bottom surface 166 of the die assembly 111 when the low pressure gas supply establishes sufficient pressure on the molten metallic material to flow molten metallic material from the chamber 153 to the interior cavity 168.

From the foregoing, it should be apparent that a new improved pressurized squeeze casting apparatus 10 has been provided for receiving molten metal material and compressing and densifying the molten metal material as the molten metal material is solidified into a solid metallic article having a predetermined near net shape. The squeeze casting apparatus 10 includes a mold means 30, 32 having an interior cavity 40 shaped substantially to form a solid article to be cast. The mold means includes a runner 42 for introducing molten metal material into the interior cavity 40. The mold means is rotatable from a first orientation, as is illustrated in FIG. 6, in which the molten metal is introduced through the runner 42 to the interior cavity 40 to a second orientation, as is illustrated in FIG. 8, in which the molten metal material is solidified into the solid article. Rotating means are provided for rotating the molding means about the substantially horizontal axis 20 from the first orientation to the second orientation after the molten metal material is introduced into the runner to flow the molten metal material from the runner 42 to the interior cavity and to prevent entrapment of air into the interior of the cavity. The rate of rotation of the molding means is controlled to minimize air entrapment in the interior cavity. In the case of a low pressure fill, the molding means may not be rotated but the fill rate will be controlled to allow the gases in the cavity to escape. A densifying means 50 is provided for mechanically applying force to the mold portion 32 to compress and densify across substantially the entire face of the article to be cast the molten metal material in the interior cavity 40. When the densifying means is actuated, a flow prevention means 70 prevents flow of metal between the interior cavity 40 and the runner 42. After the densifying means compresses and densifies the molten metal material and the molten metal material solidifies, a solid article is formed having a predetermined near net shape which requires little or minimal finishing.

What I claim is:

1. A pressurized squeeze casting apparatus for receiving molten metal material and compressing and densifying the molten metal material as the molten metal material is solidified into a solid metallic article having a predetermined near net shape comprising a first die section having a planar surface, a first mold portion supported by said first die section adjacent to said planar surface and defining a portion of an interior cavity, a second die section having a planar surface, a second mold portion supported by said second die section adjacent to said planar surface and defining a second portion of said interior cavity, said first die section and said first mold portion being movable relative to said second die section and said second mold portion between an open position in which said planar surface of said first die section is spaced apart from said planar surface of said second die section and a closed position in which said planar surface of said first die section engages said planar surface of said second die section and said portion of said interior cavity defined by said first mold portion is aligned with said second portion of said interior cavity defined by said second mold portion to substantially define an interior cavity shaped substantially to form the solid metallic article, a runner at least partially located on said planar surface of one of said die sections for introducing the molten metal material into said interior cavity when said first and second mold portions are in said closed position, densifying means for effecting relative movement of said first mold portion and said second mold portion to reduce the volume of said interior cavity after said interior cavity has been filled by said molten metal material to compress and densify the molten metal material in said interior cavity, said first mold portion being movable between a fill position in which the interior cavity is filled with molten metal material and wherein the interior cavity volume is greater than the solid metallic article to be cast and a densifying position, wherein the interior cavity volume and the volume of the molten metal material therein is reduced from the volume at the fill position to a volume substantially equal in size to the solid metallic article to be cast, and an elongate molten material shutoff element having a longitudinal axis which is substantially perpendicular to said planar surfaces of said first and second die sections for preventing the flow of molten metal material between said runner and said interior cavity when said densifying means effects reduction of the volume of said interior cavity, said molten material shutoff element being movable in a direction substantially parallel to said longitudinal axis relative to said first and second die sections between a retraced position in which said molten material shutoff element is retracted from said runner and said molten metal material flows between said runner and said interior cavity, and a sealing position in which said molten material shutoff element extends into and seals said runner to prevent said molten metal material from flowing between said runner and said interior cavity, said shutoff element having an inner side surface for engaging molten metal material in said interior cavity to in part define said interior cavity when said shutoff element is in said sealing position and outer side surface means for engaging molten metal material in said runner when said shutoff element is in said sealing position, and motor means for moving said shutoff element relative to said first and second die sections to said sealing position prior to operation of said densifying means to effect relative movement of said first mold portion and said second mold portion.

2. A pressurized squeeze casting apparatus as defined in claim 1 wherein said molten metal shutoff element has a pointed surface which extends in a direction substantially parallel to said longitudinal axis of said molten material shut-off element for engaging said molten metal material in said runner adjacent to said interior cavity when said shutoff element is moved in a direction substantially parallel to said longitudinal axis from said retracted position to said sealing position and for sealing the runner to prevent the flow of molten metal between said runner and said interior cavity, said pointed surface being located on said shutoff element adjacent to said inner side surface on said shutoff element which cooperates with said mold portion to define said interior cavity.

3. A pressurized squeeze casting apparatus for receiving molten metal material and compressing and densifying the molten metal material as the molten metal material is solidified into a solid metallic article having a predetermined near net shape comprising a first die section having a planar surface on which a first mold portion shaped to define a portion of the metallic article is located, a second die section having a planar surface on which a second mold portion shaped to define another portion of the metallic article is located, said second mold portion and said first mold portion being relatively movable in a direction substantially perpendicular to said planar surfaces between an open position in which said planar surface of said first die section is spaced apart from said planar surface of said second die section and a closed position in which said planar surface of said first die section engages said planar surface of said second die section, said first mold portion and said second mold portion being shaped and cooperating to define a substantial portion of an interior cavity shaped substantially to form the metallic article to be cast when said first and second mold portions are in said closed position, a runner located on at least one of said planar surfaces of said first and second die sections for introducing a supply of molten metal material to said interior cavity, densifying means for forcibly moving said first mold portion relative to said second mold portion to reduce the volume of said interior cavity after said interior cavity has been filled with molten metal material to compress the molten metal material in said interior cavity across substantially the entire face of the metallic article to be cast, and flow prevention means for preventing the flow of molten metal material between said runner and said interior cavity when said densifying means effects reduction of the volume of said interior cavity, said first mold portion when said first and second mold portions are in said closed position being movable between a fill position, wherein the interior cavity volume is greater than the volume of the solid metallic article to be cast and a densifying position, wherein the interior cavity volume is reduced by said densifying means to equal the volume of the solid metallic article, said flow prevention means includes a molten material shutoff element having a longitudinal axis disposed substantially perpendicular to said planar surfaces of said first and second die sections for sealing said runner, said shutoff element being movable in a direction substantially parallel to said longitudinal axis from a retracted position in which said shutoff element is retracted from said runner and said molten metal material flows between said runner and said interior cavity to a sealing position in which said shutoff element seals said runner prior to operation of said densifying means to move said first mold portion relative to said second mold portion to prevent said molten metal material from flowing between said runner and said interior cavity, during operation of said densifying means.

* * * * *